US008680827B2

(12) United States Patent
Nagasaki et al.

(10) Patent No.: US 8,680,827 B2
(45) Date of Patent: Mar. 25, 2014

(54) HIGH-VOLTAGE POWER SUPPLY APPARATUS AND IMAGE FORMING APPARATUS EMPLOYING SAME

(75) Inventors: Osamu Nagasaki, Numazu (JP); Hiroshi Mano, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 1006 days.

(21) Appl. No.: 12/128,270

(22) Filed: May 28, 2008

(65) Prior Publication Data

US 2008/0297129 A1 Dec. 4, 2008

(30) Foreign Application Priority Data

Jun. 4, 2007 (JP) ..... 2007-148626
Dec. 20, 2007 (JP) ..... 2007-329209
Apr. 14, 2008 (JP) ..... 2008-104947

(51) Int. Cl.
*G05F 1/565* (2006.01)
*G05F 1/575* (2006.01)

(52) U.S. Cl.
USPC ..... 323/275; 323/280; 363/21.03; 363/21.09

(58) Field of Classification Search
USPC ..... 323/298, 271–281; 399/37, 88; 363/18, 363/19, 21.02, 21.03, 21.09
See application file for complete search history.

(56) References Cited

U.S. PATENT DOCUMENTS 3,674,881 A * 7/1972 Lukes et al. ..... 570/226
4,462,069 A * 7/1984 Becky ..... 363/23
4,642,556 A * 2/1987 Pecukonis ..... 324/67
7,548,708 B2 * 6/2009 Nagasaki et al. ..... 399/88
2009/0033303 A1 * 2/2009 Kondo ..... 323/283

FOREIGN PATENT DOCUMENTS

JP 11-206113 A 7/1999
JP 2007-43891 A 2/2007

OTHER PUBLICATIONS

Notification of Reasons for Refusal mailed Nov. 19, 2012, in Japanese Application No. 2008-104947.

* cited by examiner

*Primary Examiner* — Adolf Berhane
*Assistant Examiner* — Nusrat Quddus
(74) *Attorney, Agent, or Firm* — Fitzpatrick, Cella, Harper & Scinto

(57) ABSTRACT

The voltage at a spurious frequency is decreased while maintaining as much as possible the voltage at a resonance frequency of a piezoelectric transformer, thus controlling a wide voltage range with a comparatively low cost configuration. A high-voltage power supply apparatus includes a piezoelectric transformer that outputs a highest voltage at a predetermined resonance frequency, and a generating unit that generates a signal that oscillates at a drive frequency that drives the piezoelectric transformer, throughout a frequency range that includes the resonance frequency. Furthermore, the high-voltage power supply apparatus includes an output terminal connected to the piezoelectric transformer, and a constant-voltage element inserted in a path that couples the piezoelectric transformer and the output terminal.

15 Claims, 19 Drawing Sheets

PRIOR ART

PRIOR ART

PRIOR ART

HIGH-VOLTAGE POWER SUPPLY APPARATUS AND IMAGE FORMING APPARATUS EMPLOYING SAME

BACKGROUND OF THE INVENTION

1. Field of the Invention

The present invention relates to an image forming apparatus, and more specifically relates to a high-voltage power supply apparatus employed in an image forming apparatus.

2. Description of the Related Art

In an electrophotographic image forming apparatus, transfer of a toner image is expedited by applying a direct current bias voltage to a transfer roller formed by wrapping a roller-like conductive rubber around a metal shaft. In order for transfer to be performed well, ordinarily, electric current of high voltage (voltage of at least several hundred volts greater than the voltage of a commercial power source) and about 10 μA is caused to flow to the transfer roller.

In order to generate this sort of high voltage, conventionally, a wire wound type electromagnetic transformer is used. However, an electromagnetic transformer is an obstacle to reducing the size and weight of a high-voltage power supply apparatus. Consequently, use of a piezoelectric transformer (a piezoelectric ceramic transformer) is being investigated. With a piezoelectric transformer, high voltage can be generated with greater efficiency than an electromagnetic transformer, and moreover, a mold process for isolating electrodes of a primary side and a secondary side is also unnecessary. Therefore, a piezoelectric transformer has the advantage of allowing reduction of the size and weight of high-voltage power supply apparatuses.

In the circuit design of an ordinary piezoelectric transformer type high-voltage power supply apparatus, the voltage that is output is controlled according to frequency (Japanese Patent Application Laid-open No. H11-206113).

However, in a conventional circuit design, spurious frequencies are generated in the range of resonance frequencies. When a spurious frequency is generated, the output voltage becomes unstable in response to variation of load or minute changes in transformer performance, and thus it becomes difficult to obtain a high quality image. Therefore, it is desirable to decrease the output voltage at a spurious frequency.

The inventors of the present application investigated inserting a series resistor in a current path that runs from a rectifier circuit provided in a latter stage of a piezoelectric transformer. However, the inventors learned that when a series resistor is inserted, there is the drawback that not only the voltage at a spurious frequency, but also the highest voltage at a resonance frequency f0 decreases. Furthermore, the inventors also investigated a circuit design in which the reduction in the highest voltage at the resonance frequency f0 is suppressed by switching the series resistor during high-voltage output with a relay. However, this design as well could require the addition of expensive and/or complicated circuits.

SUMMARY OF THE INVENTION

Consequently, it is a feature of the present invention to address at least one among these and other problems. For example, it is a feature of the invention to make it possible to reduce the voltage when a spurious frequency is generated while maintaining as much as possible the voltage at a resonance frequency of a piezoelectric transformer, so that a wide voltage range can be controlled with a comparatively low cost design. Other problems shall be understood from the whole of the specification.

The invention is applicable to a high-voltage power supply apparatus and an image forming apparatus in which the high-voltage power supply apparatus is used. The high-voltage power supply apparatus includes a piezoelectric transformer that outputs a highest voltage at a predetermined resonance frequency, and a generating unit that generates a signal that oscillates at a drive frequency that drives the piezoelectric transformer, throughout a predetermined frequency range that includes the resonance frequency. Furthermore, the high-voltage power supply apparatus includes an output terminal connected to a path extended from the piezoelectric transformer, and a constant-voltage element inserted in the path, the path coupling the piezoelectric transformer and the output terminal.

From another aspect of the invention, the high-voltage power supply apparatus includes an oscillator, a switching element, an element having an inductance component, a piezoelectric transformer, an output terminal, and a constant-voltage element. The oscillator variably sets the frequency of an output signal according to a control signal that has been input. The switching element is driven by the output signal of the oscillator. The element having an inductance component is connected between the switching element and a power source, and voltage is intermittently applied to this element by driving of the switching element. The piezoelectric transformer is connected at a connection point of the switching element and the element having an inductance component, and outputs a highest voltage when a signal that oscillates at a predetermined resonance frequency is applied. The output terminal is connected to a path extended from the piezoelectric transformer. The constant-voltage element is inserted into the path coupling the piezoelectric transformer and the output terminal.

From still another aspect of the invention, the image forming apparatus includes a latent image forming unit that forms an electrostatic latent image on an image carrier, a development unit that develops the electrostatic latent image to form a toner image, a transfer unit that transfers the toner image to a recording material, and a fixing unit that fixes the toner image to the recording material to which the toner image has been transferred. In particular, the image forming apparatus includes the aforementioned high-voltage power supply apparatus as a unit that applies, to the transfer unit, a transfer voltage that expedites transfer of the toner image to the recording material.

Further features of the present invention will become apparent from the following description of exemplary embodiments (with reference to the attached drawings).

DESCRIPTION OF THE EMBODIMENTS

Below, exemplary embodiments of the invention will be disclosed. Individual exemplary embodiments described below serve as an aid to understanding various concepts of the invention, such as generic concepts, less generic concepts, and specific concepts. The technical scope of the invention is defined by the scope of the claims, and not by the individual exemplary embodiments below.

Related Art

Figure 15:
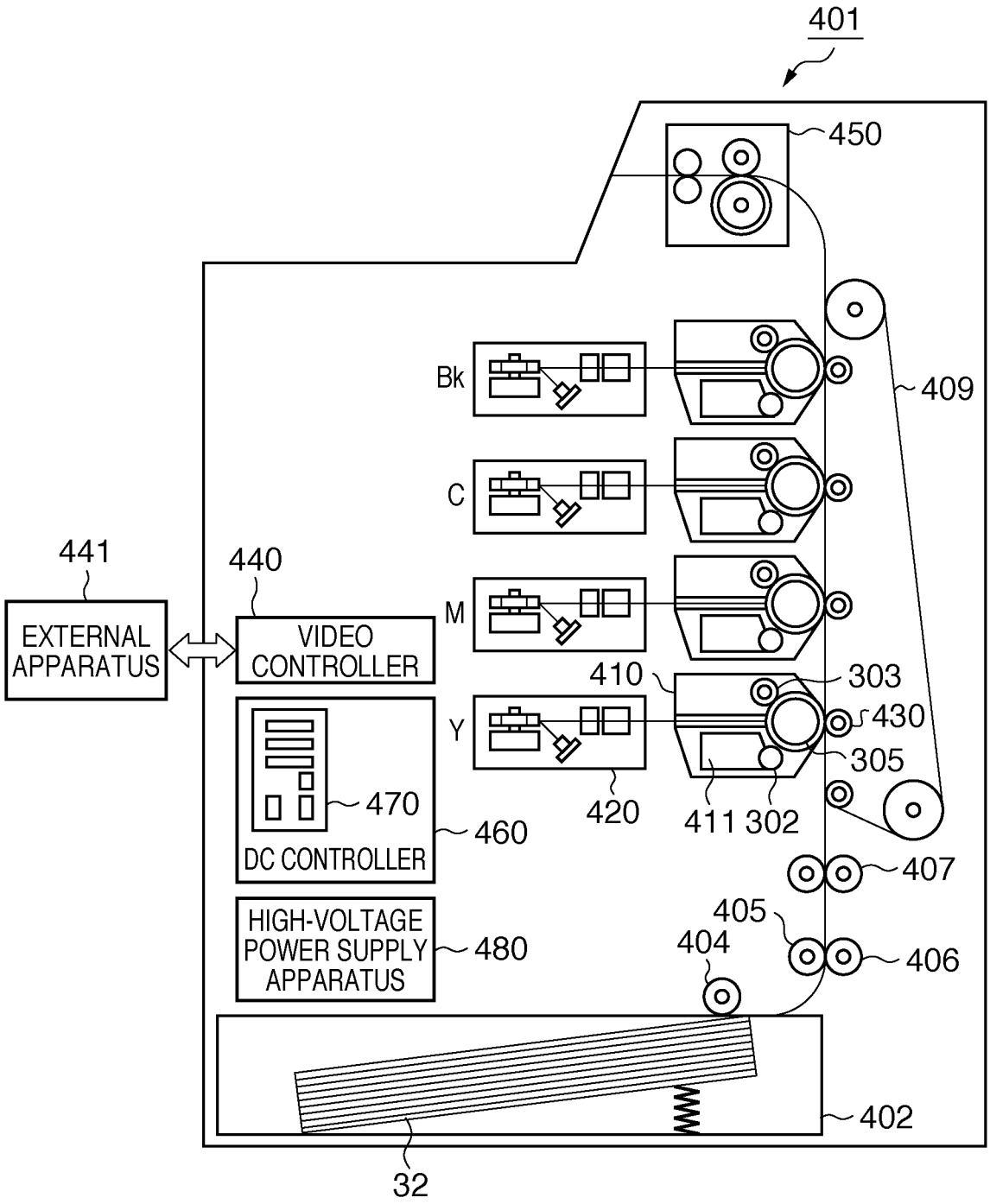
FIG. 15 is a configuration diagram of a color laser printer according to Embodiment 5.
Figure 16:
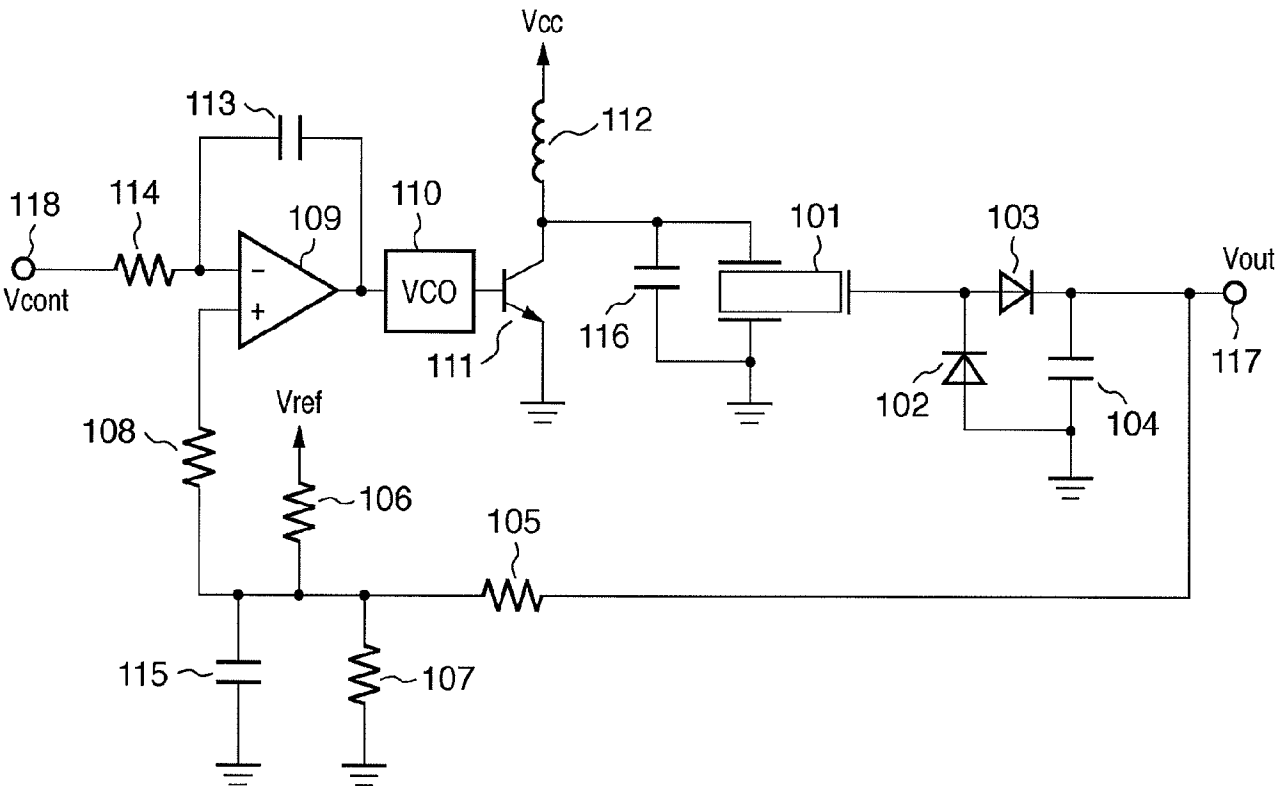
FIG. 16 is a circuit diagram of a piezoelectric transformer type high-voltage power supply apparatus according to the related art.

FIG. 16 is a circuit diagram of a piezoelectric transformer type high-voltage power supply apparatus according to the related art. A piezoelectric transformer 101 is adopted instead of a conventional wire wound type electromagnetic transformer. Output of the piezoelectric transformer 101 is rectified/smoothed to a positive voltage by a rectifying/smoothing circuit. The rectifying/smoothing circuit is configured from high-voltage diodes 102 and 103, and a high-voltage capacitor 104. The output voltage of the piezoelectric transformer 101 is output from an output terminal 117 connected to a path extended from the piezoelectric transformer 101, and supplied to a load (example: a transfer roller (FIG. 15) or the like). Also, the output voltage is divided by resistors 105, 106, and 107, and input to a non-inverting input terminal (+ terminal) of an op-amp 109 via a capacitor 115 and a protective resistor 108.

On the other hand, an analog signal (control signal (Vcont) of the high-voltage power supply apparatus) that has been input from an input terminal 118 is input to an inverting input terminal (− terminal) of the op-amp 109, via a resistor 114. The op-amp 109, the resistor 114, and the capacitor 113 function as an integrator circuit. That is, the control signal Vcont, which has been smoothed according to an integration time constant determined by a component constant of the resistor 114 and the capacitor 113, is input to the op-amp 109. The output terminal of the op-amp 109 is connected to a voltage-controlled oscillator (VCO) 110. The voltage-controlled oscillator 110 is an example of an oscillator that can variably set the frequency of an output signal according to an input control signal.

Also, an output terminal of the voltage-controlled oscillator 110 is connected to the gate of a field-effect transistor 111. The field-effect transistor 111 is an example of a switching element that is driven by an oscillator output signal. The drain of the field-effect transistor 111 is connected to a power source (+24V: Vcc) via an inductor 112, and is grounded via a capacitor 116. The inductor 112 is an element connected between the switching element and the power source, and is an example of an element having an inductance component to which voltage is intermittently applied by driving of the switching element. Furthermore, the drain is connected to one primary-side electrode of the piezoelectric transformer 101. The other primary-side electrode of the piezoelectric transformer 101 is grounded. The source of the field-effect transistor 111 is also grounded.

The voltage-controlled oscillator (VCO) 110 switches the field-effect transistor 111 at a frequency according to the output voltage of the op-amp 109. The inductor 112 and the capacitor 116 form a resonance circuit. Voltage that has been amplified by this resonance circuit is supplied to the primary side of the piezoelectric transformer 101. In this way, the piezoelectric transformer 101 is connected at a connection point of the switching element and the element having an inductance component, and outputs the highest voltage when a signal that oscillates at a predetermined resonance frequency is applied.

Figure 17:
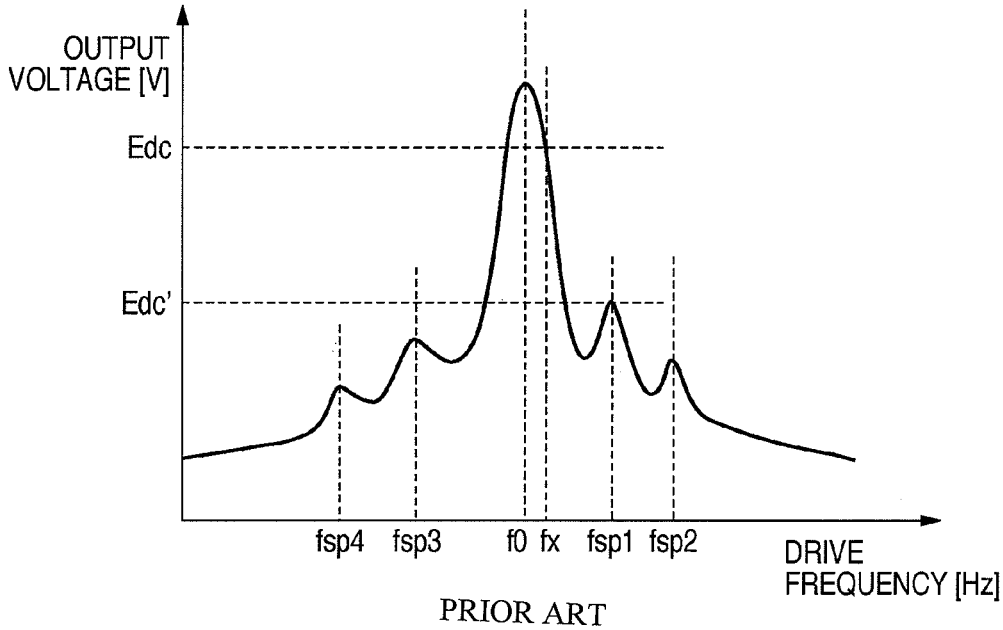
FIG. 17 shows characteristics of a piezoelectric transformer.
Figure 18:
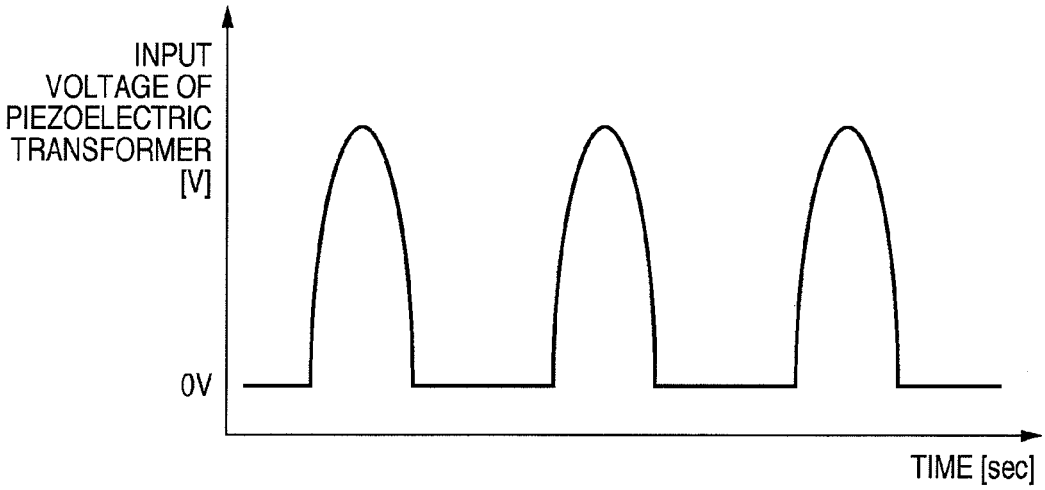
PRIOR ART FIG. 18
FIG. 18 shows an example of an input voltage waveform that is input to a piezoelectric transformer.

The voltage-controlled oscillator 110 operates so as to raise the output frequency when the input voltage increases, and lower the output frequency when the input voltage decreases. With respect to this condition, when an output voltage Edc increases, an input voltage Vsns of the non-inverting input terminal (+ terminal) of the op-amp 109 via the resistor 105 also increases, and the voltage of the output terminal of the op-amp 109 also increases. That is, because the input voltage of the voltage-controlled oscillator 110 increases, the drive frequency of the piezoelectric transformer 101 also increases. In a frequency region higher than the resonance frequency, the output voltage of the piezoelectric transformer 101 decreases when the drive frequency increases (FIGS. 17 and 18). That is, the circuit shown in FIG. 16 constitutes a negative feedback control circuit. This negative feedback control circuit is an example of a feedback control mechanism for keeping the voltage output from the piezoelectric transformer 101 constant.

Also, when the output voltage Edc decreases, the input voltage Vsns of the op-amp 109 also decreases, and the voltage of the output terminal of the op-amp 109 also decreases. Thus, the output frequency of the voltage-controlled oscillator 110 also decreases, and feedback control is executed in the direction that increases the output voltage of the piezoelectric transformer 101.

In this way, the output voltage is controlled to be a constant voltage, so as to be the same as a voltage determined by the voltage (referred to below as an output control value) of the high-voltage output control signal (Vcont) from a DC controller 460 that is input to the inverting input terminal (− terminal) of the op-amp 109.

FIG. 17 shows an example of piezoelectric transformer characteristics. Here, piezoelectric transformer characteristics are shown as an output voltage relative to the drive frequency. As is understood from FIG. 17, the characteristics have a shape that spreads toward the bottom. In particular, the output voltage is highest at the resonance frequency f0. In this way, the output voltage can be controlled by the drive frequency applied to the piezoelectric transformer 101.

It is understood from FIG. 17 that in a case where the output voltage is controlled with a drive frequency that is higher than the resonance frequency f0, it is possible to increase the output voltage of the piezoelectric transformer 101 if the drive frequency is changed from a higher frequency to a lower frequency. Conversely, it is understood that in a case where the output voltage is controlled with a drive frequency that is lower than the resonance frequency f0, the output voltage can be increased if the drive frequency is changed from a higher frequency to a lower frequency.

Ordinarily, the operating frequency range of the voltage-controlled oscillator 110 is set to a range that includes the resonance frequency f0. However, depending on the structure of the piezoelectric transformer 101 and the input voltage waveform, undesired resonance frequencies (resonance frequencies other than f0, referred to below as spurious frequencies) fsp1 to fsp4 or the like are present.

FIG. 18 shows an example of an input voltage waveform that is input to a piezoelectric transformer. According to FIG. 18, the input voltage waveform is a flyback waveform.

Figure 19:
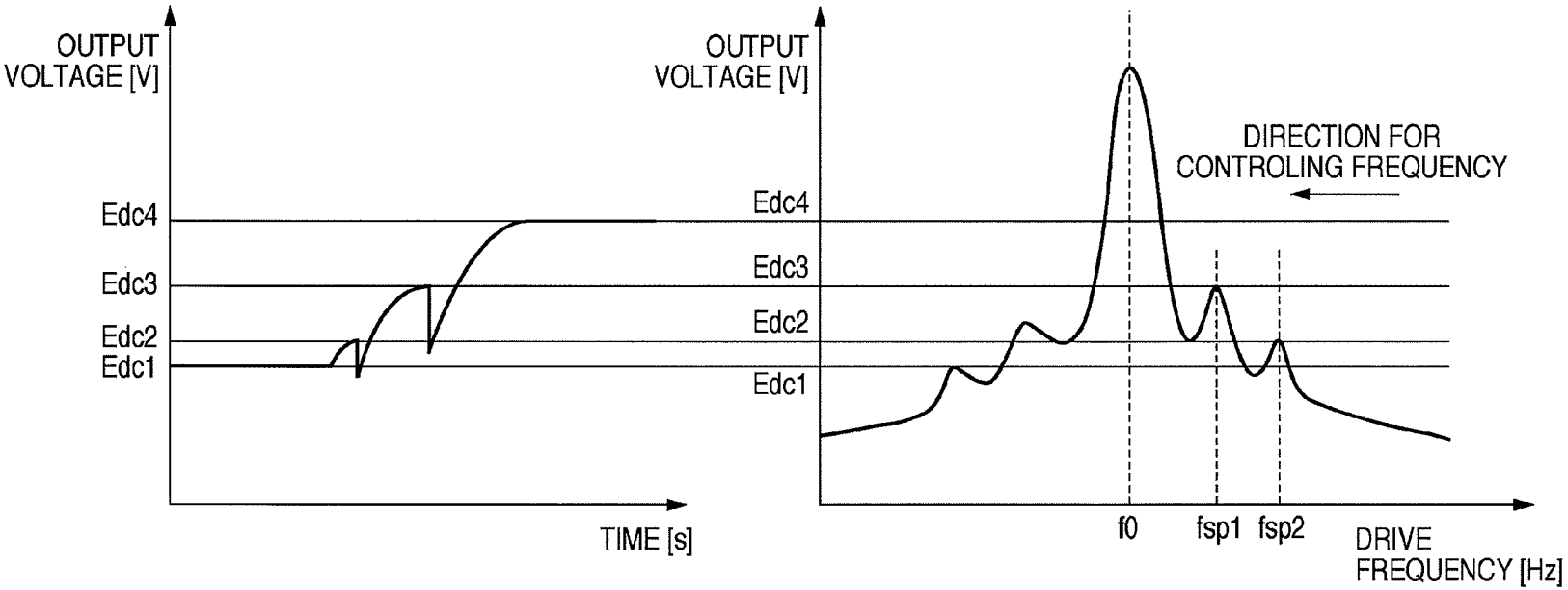
FIG. 19 shows output voltages relative to output voltage startup time and drive frequency, in a case where output voltage is high for a spurious frequency.

FIG. 19 shows output voltages relative to output voltage startup time and drive frequency, in a case where output voltage is high for a spurious frequency. In order to obtain a desired output voltage Edc, it is assumed to sweep from a sufficiently high drive frequency to a drive frequency fx (FIG. 17) near the resonance frequency f0. The desired output voltage Edc is obtained at the drive frequency fx. In this case, when sweeping to the drive frequency fx, each of the spurious frequencies fsp1 and fsp2 are passed in order. As is understood from FIGS. 17 and 19, an undulation occurs in the output voltage at each of the spurious frequencies fsp1 and fsp2. When this sort of undulation is present, the frequency sweep time due to voltage feedback is delayed, so the startup time to the output voltage Edc is lengthened.

This drawback can be compensated for if the output voltage is started up earlier than the timing required by the desired output voltage (high voltage), and raised higher than the voltage value at a spurious frequency. That is, ordinarily the voltage is controlled in a range that is higher than the voltage at a spurious frequency and lower than the highest voltage at the resonance frequency f0. However, in exchange for improving the startup time, the range of the output voltage is reduced. Note that in order to suppress the occurrence of these spurious frequencies, it is effective to input a voltage that does not include a harmonic component such as a sine wave or the like to the piezoelectric transformer 101.

Also, as shown in FIG. 17, when it is desired to output a voltage Edc' at the same level as the voltage at the spurious frequency fsp2, an undulation occurs in the output voltage due to minute changes in variation of load or transformer performance. As a result, it is possible that a high quality image will not be obtained.

For example, in environmental conditions from normal temperature to high temperature and high humidity, when transferring toner to a recording material having a high resistance value, much transfer current will flow. Because the charge on a photosensitive drum that has been charged to a predetermined potential is de-charged by current that flows into a transfer unit, the surface potential after transfer will decrease. When the surface potential changes greatly, a primary charger cannot adequately eliminate a history of the surface potential, and thus ghosting occurs. This ghosting leads to differences in darkness, and therefore is not preferable.

As a way of addressing this ghosting, there is a method of reducing the output voltage from a high-voltage power supply apparatus as much as possible. However, as described above, due to undulations in the output voltage at spurious frequencies, low voltage cannot be stably output. Thus, it is necessary to provide a control range at or above a voltage Edc3 (for example, +500V) that is higher than the output voltage at a spurious frequency, and so appropriate voltage control is difficult.

Embodiment 1

Figure 1:
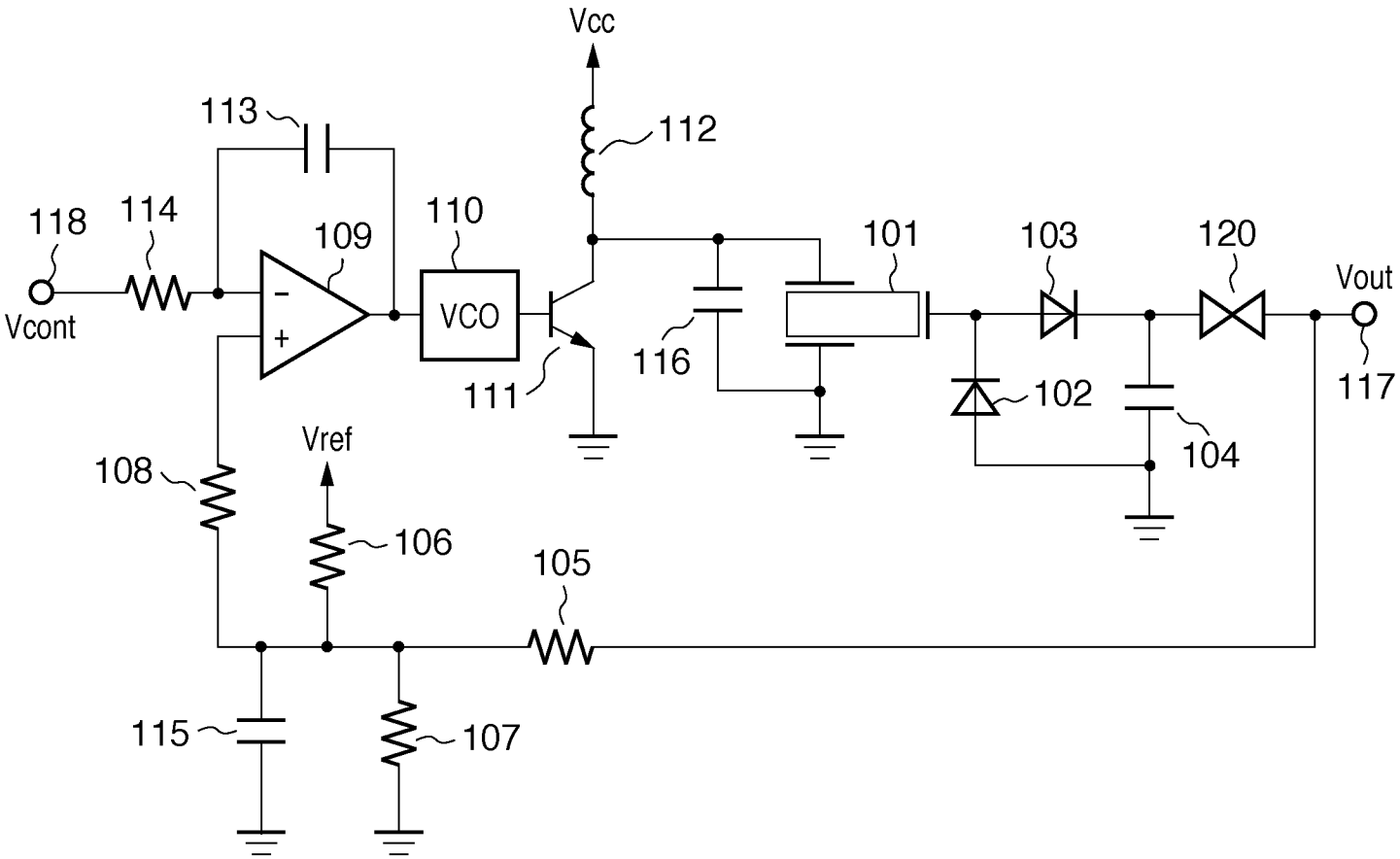
FIG. 1 is a circuit diagram that shows an example of a piezoelectric transformer type high-voltage power supply apparatus according to Embodiment 1.

FIG. 1 is a circuit diagram that shows an example of a piezoelectric transformer type high-voltage power supply apparatus according to Embodiment 1. Note that the description is shortened by giving the same reference numerals to previously described locations. Also, the invention is effective for a high-voltage power supply apparatus that outputs either positive voltage or negative voltage. Here, as one example, a high-voltage power supply apparatus that outputs positive voltage will be described.

A piezoelectric transformer 101 outputs a highest voltage at a predetermined resonance frequency. A voltage-controlled oscillator 110, a field-effect transistor 111, an inductor 112, and a capacitor 116 are an example of a generating unit that generates a drive frequency (a signal that oscillates at the drive frequency) for driving the piezoelectric transformer 101 throughout a predetermined frequency range that includes the resonance frequency. Ordinarily, frequency refers to the number of times that a signal oscillates in one second, but may also mean this signal itself.

In particular, a constant-voltage element (a varistor 120) is inserted in a path that couples the piezoelectric transformer 101 and an output terminal 117. The constant-voltage element is an element that suppresses voltages (examples: Edc2 and Edc3) at spurious frequencies that are generated in the piezoelectric transformer 101, to below a voltage (Edc4) at a resonance frequency f0. As is understood from FIG. 1, the varistor 120 is inserted between a cathode of a high-voltage diode 103 and an output terminal 117. Also, voltage that is output from the varistor 120 is fed back by a feedback control mechanism.

Described more specifically, the varistor 120 is inserted in series as a constant-voltage element between a rectifier circuit (the high-voltage diode 103 and a high-voltage capacitor 104 for smoothing) and the output terminal 117, on a current path from the piezoelectric transformer 101 to the output terminal 117. A resistor 105 for detecting output voltage is connected between the varistor 120 and the output terminal 117.

Figure 2:
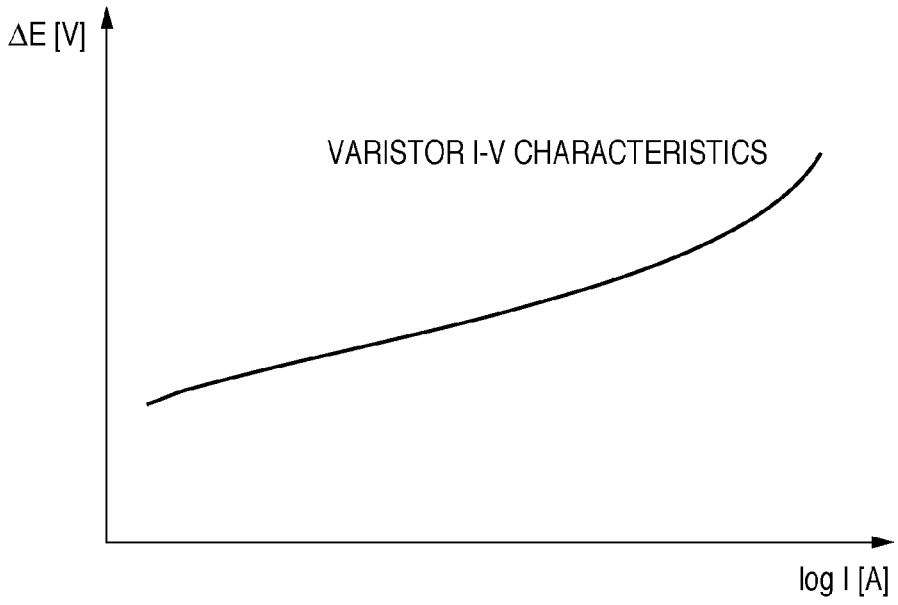
FIG. 2 shows current-voltage characteristics of an ordinary varistor 120.

FIG. 2 shows current-voltage characteristics of an ordinary varistor 120. The horizontal axis indicates current I (logarithmic). The vertical axis indicates voltage ΔE at both ends. It is understood from FIG. 2 that a both end voltage ΔE of the varistor 120 varies according to the current that flows to the varistor 120.

Figure 3:
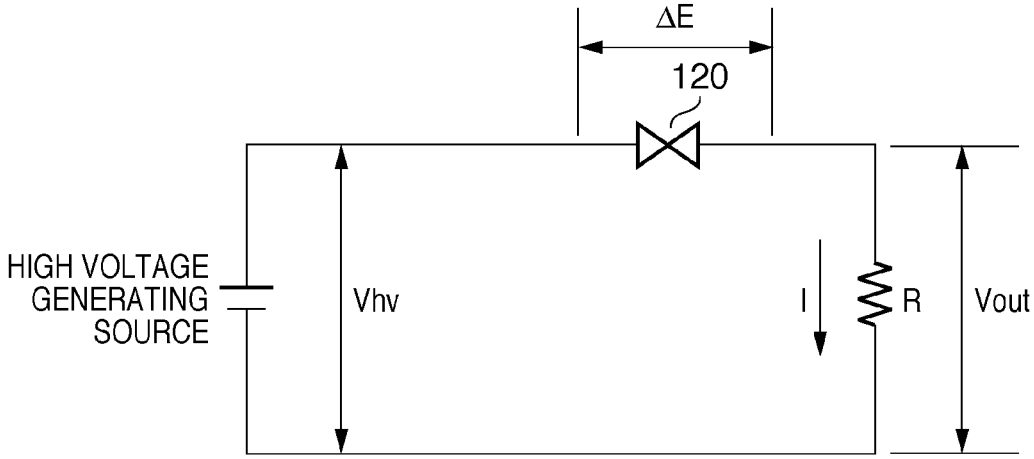
FIG. 3 shows an equivalent circuit when a load side is viewed from a high-voltage generating source that includes a piezoelectric transformer and a rectifier circuit.

FIG. 3 shows an equivalent circuit when a load side is viewed from a high-voltage generating source that includes a piezoelectric transformer or a rectifier circuit. Here, Vhv is the voltage of the high-voltage generating source (a circuit that includes the piezoelectric transformer 101 and the high-voltage diode 103), Vout is the voltage applied to a load resistor, and the both end voltage (potential difference) of the varistor 120 is ΔE.

Figure 4:
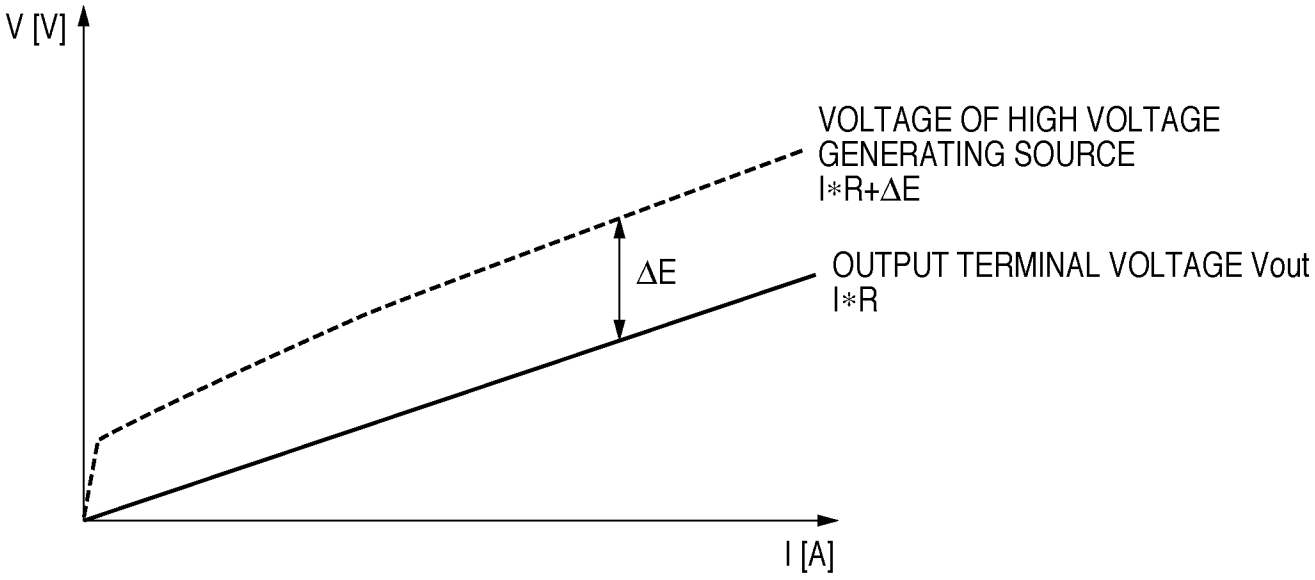
FIG. 4 shows an example of voltage change due to current variation of each portion of the equivalent circuit in FIG. 3.

FIG. 4 shows an example of voltage change due to current variation of each portion of the equivalent circuit in FIG. 3. The horizontal axis indicates current I (actual). The vertical axis indicates voltage. Here, the output voltage Vout at the output terminal 117 is a value proportional to load resistance, and is expressed by $$V\text{out}=I\times R.$$

Also, the voltage Vhv of the high-voltage generating source is a value obtained by adding the both end voltage ΔE of the varistor 120, which varies according to current, to the output voltage Vout, and is expressed by $$Vhv=I\times R+\Delta E.$$

Figure 5A:
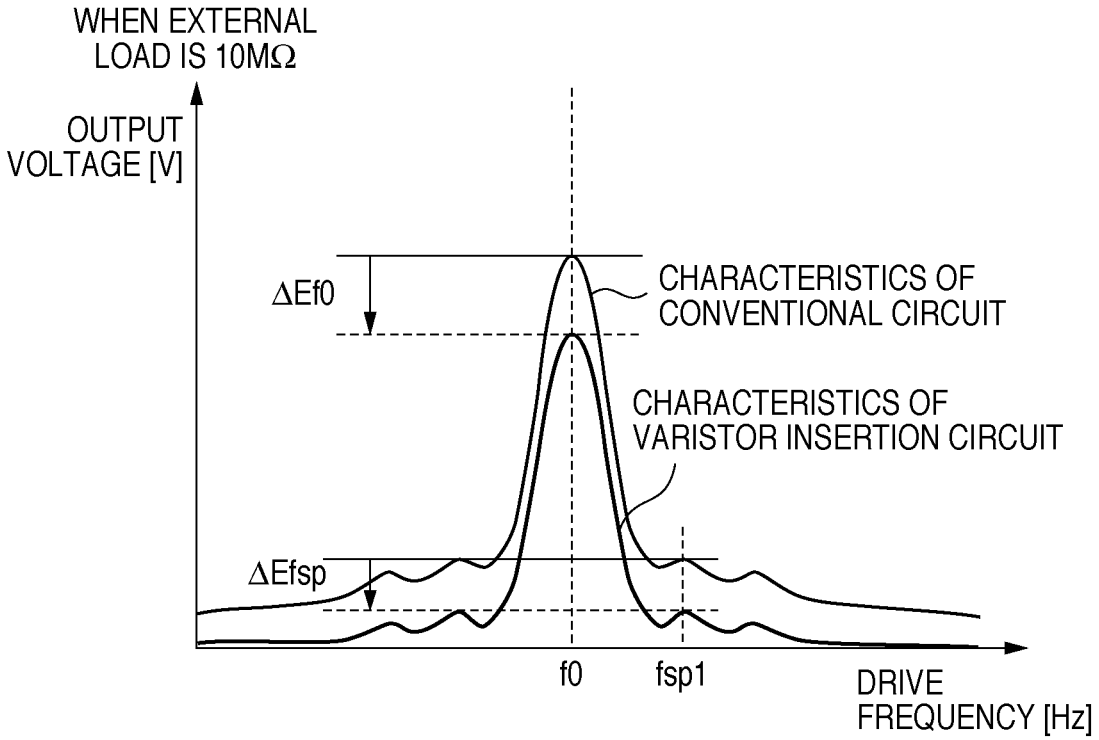
FIG. 5A shows frequency characteristics for a case where a varistor is inserted (varistor insertion circuit) and a case where a varistor is not inserted (conventional circuit), when an external load is set to 10 MΩ.
Figure 5B:
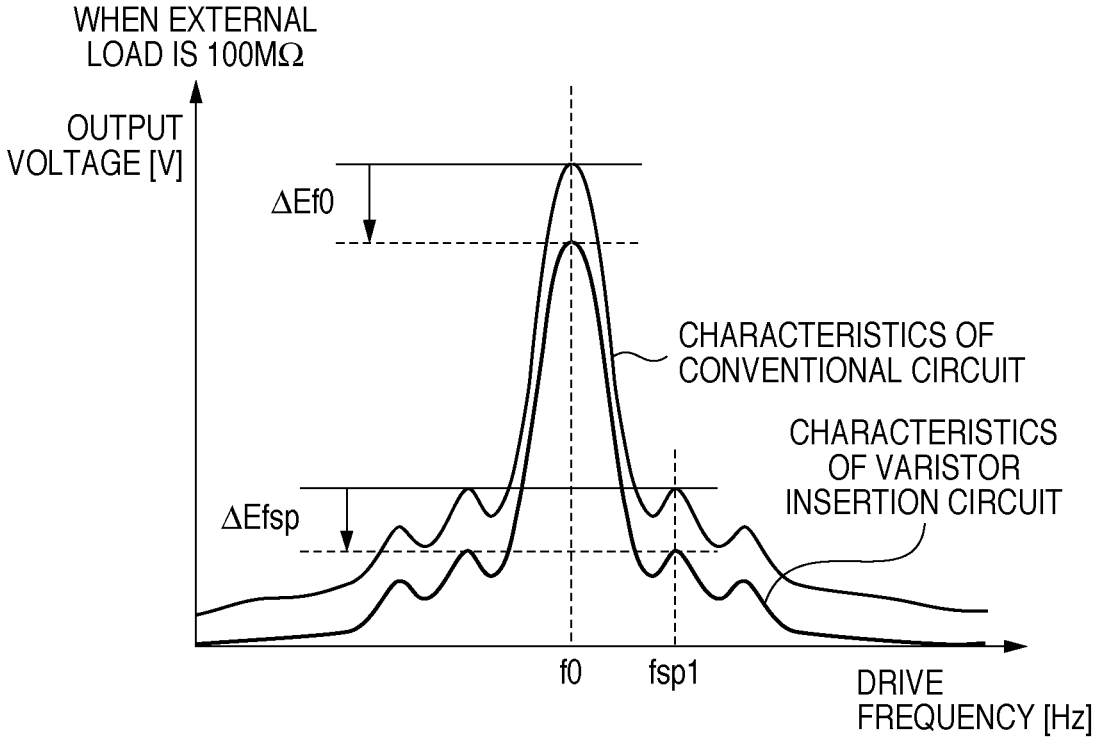
FIG. 5B shows frequency characteristics for a case where a varistor is inserted and a case where a varistor is not inserted, when an external load is set to 100 MΩ.

FIG. 5A shows frequency characteristics for a case where a varistor is inserted (varistor insertion circuit) and a case where a varistor is not inserted (conventional circuit), when an external load is set to 10 MΩ. FIG. 5B shows frequency characteristics for a case where a varistor is inserted and a case where a varistor is not inserted, when an external load is set to 100 MΩ. Note that in FIGS. 5A and 5B, the scales of the vertical axis and the horizontal axis are the same.

Here, load conditions are assumed to be as follows. The resistance value of members decreases in a high temperature and high humidity environment. Thus, an external load becomes 10 MΩ, and a control or the like is performed such that the voltage applied to the load is suppressed to a low value in order to maintain the supplied current. Accordingly, the control range of the output voltage is set to a low voltage (for example, such as 200 to 1000 V) as an absolute value.

On the other hand, the resistance value of members increases in a low temperature and low humidity environment. Thus, an external load becomes 100 MΩ, and a control or the like is performed such that the voltage applied to the load is high in order to maintain the supplied current. Accordingly, the control range of the output voltage is set to a high voltage (for example, such as 600 to 2000 V) as an absolute value.

Where the external load is 10 MΩ and 100 MΩ, a difference is expressed in the characteristics themselves of a conventional circuit. It is understood from FIGS. 5A and 5B that the characteristics for an external load of 10 MΩ have a lower voltage level than the characteristics for an external load of 100 MΩ. Accordingly, both the highest voltage at the resonance frequency f0 and the spurious voltage at the spurious frequency fsp1 decrease as the load resistance becomes smaller. This is because as the load resistance becomes smaller, the power consumption of the piezoelectric transformer 101 increases.

Also, the following can be said as a result of the frequency characteristics for an external load of 10 MΩ. With respect to the difference in the characteristics of a conventional circuit and the characteristics of a varistor insertion circuit, ΔEf0 is the difference in voltage at the resonance frequency f0, and ΔEfsp is the difference in voltage at the spurious frequency fsp1. In this case, it is understood from FIGS. 5A and 5B that $$\Delta Ef0>\Delta Efsp.$$

The same relationship can be stated for the characteristics for an external load of 100 MΩ.

As in this exemplary embodiment, when the external load is fixed across an entire drive frequency range, the current I is greater with the high voltage output at the resonance frequency f0 than with the low voltage output at the spurious frequency fsp1. Thus, the varistor potential difference ΔE is also greater.

From such characteristics, $$\Delta Ef0>\Delta Efsp$$

is established.

However, because more current flows as the resistance value of the external load decreases, the absolute values of ΔEf0 and ΔEfsp each increase. From this relationship, the following can be said with respect to output control of the transfer voltage during image formation.

In a high temperature and high humidity environment (here, when the external load is 10 MΩ, the output voltage for guaranteeing image quality is set to a low voltage range. Accordingly, with the effects of this exemplary embodiment, it is possible to increase the voltage range on the low voltage side, because the voltage at the spurious frequency fsp1 decreases. At this time, although the highest voltage at the resonance frequency f0 also likewise decreases, the upper limit value of the voltage is set so that a margin has been insured.

On the other hand, in a low temperature and low humidity environment (here, when the external load is 100 MΩ), the output voltage for guaranteeing image quality is set to a high voltage range. Accordingly, with the effects of this exemplary embodiment, the voltage decrease at the resonance frequency f0 is suppressed as much as possible, and a margin is easily insured for the upper limit value of the voltage range. Also, even in a state in which the voltage at the spurious frequency fsp1 is not sufficiently decreased, the lower limit value of the voltage range is set so that a margin has been insured. In this way, this is a design in which favorable settings are possible for the output voltage.

Figure 20:
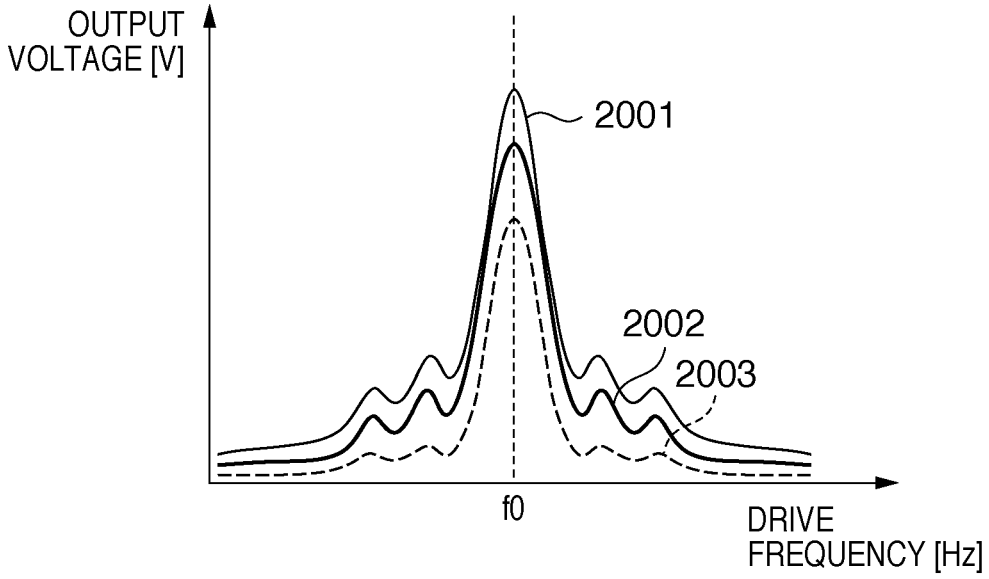
FIG. 20 shows frequency characteristics at both ends of a constant-voltage element according to an external load.

FIG. 20 shows frequency characteristics at both ends of the constant-voltage element according to the external load. The horizontal axis indicates drive frequency. The vertical axis indicates output voltage from the constant-voltage element. A solid line 2001 indicates, of the characteristics of the constant-voltage element, the characteristics of the rectifier circuit side. A solid line 2002 indicates, of the characteristics of the constant-voltage element, the characteristics of the load (output terminal) side (when the external load is 100 MΩ). A broken line 2003 indicates, of the characteristics of the constant-voltage element, the characteristics of the load (output terminal) side (when the external load is 10 MΩ).

Figure 21:
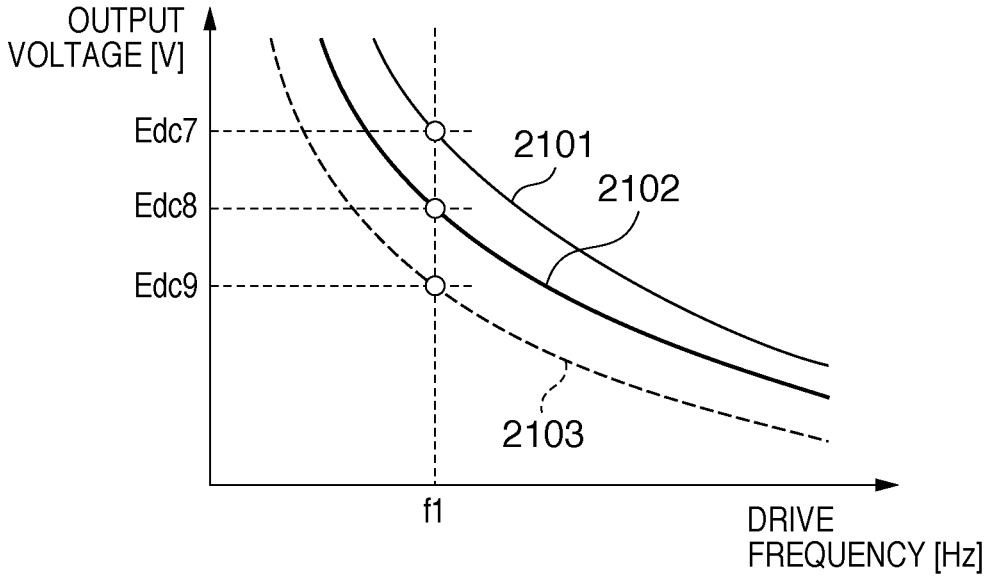
FIG. 21 shows various characteristics in the case of feedback of the voltage of the rectifier circuit side of the constant-voltage element.

FIG. 21 shows various characteristics in the case of feedback of the voltage of the rectifier circuit side of the constant-voltage element. A solid line 2101 indicates, of the characteristics of the constant-voltage element, the characteristics of the rectifier circuit side. A solid line 2102 indicates, of the characteristics of the constant-voltage element, the characteristics of the load (output terminal) side (note that the external load is 100 MΩ). A broken line 2103 indicates, of the characteristics of the constant-voltage element, the characteristics of the load (output terminal) side (when the external load is 10 MΩ).

Ordinarily, voltage is fed back when performing constant-voltage control of output of a high voltage. In particular, when feeding back voltage of the rectifier circuit side of the constant-voltage element, the voltage of the output terminal relative to a target voltage Edc7 is affected by the current of the constant-voltage element or the external load, and falls. Note that the drive frequency is fixed at f1. Thus, when for example the external load is 100 MΩ, the voltage of the output terminal falls to Edc8. Likewise, when the external load is 10 MΩ, the voltage of the output terminal falls to Edc7. In this way, the output voltage differs according to the external load and the current. This means that stable constant-voltage control cannot be realized.

Figure 22:
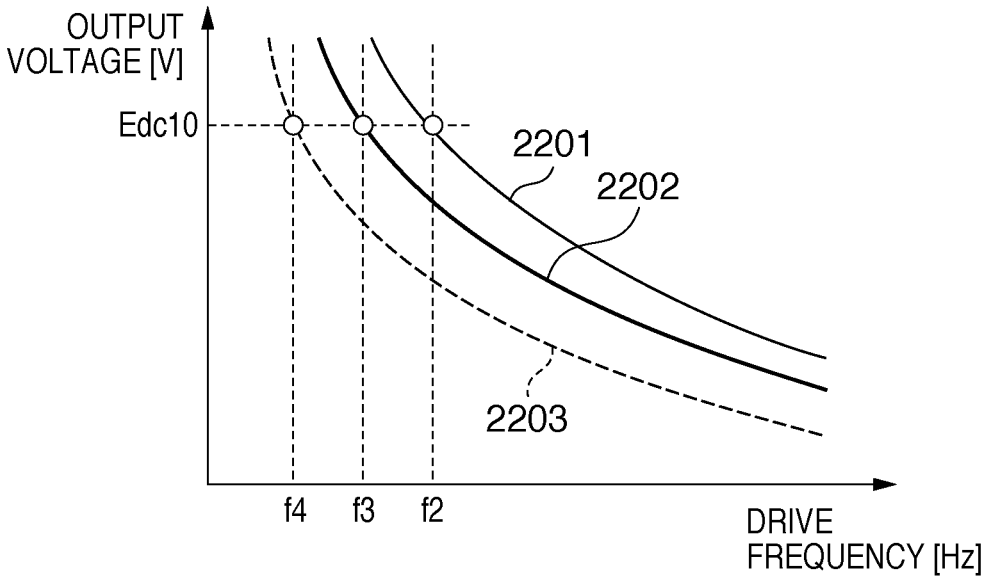
FIG. 22 shows various characteristics in the case of feedback of the voltage of the load (output terminal) side of the constant-voltage element.

FIG. 22 shows various characteristics in the case of feedback of the voltage of the load (output terminal) side of the constant-voltage element. A solid line 2201 indicates, of the characteristics of the constant-voltage element, the characteristics of the rectifier circuit side. A solid line 2202 indicates, of the characteristics of the constant-voltage element, the characteristics of the load (output terminal) side (note that the external load is 100 MΩ). A broken line 2203 indicates, of the characteristics of the constant-voltage element, the characteristics of the load (output terminal) side (when the external load is 10 MΩ).

As shown in FIG. 22, if voltage of the load side of the constant-voltage element is fed back, it is difficult for the voltage of the output terminal relative to a target voltage Edc10 to depend on the constant-voltage element, the current, and the external load. Thus stable constant-voltage control is realized. However, the drive frequency changes in the manner of f3 and f4 according to the load conditions.

Figure 23:
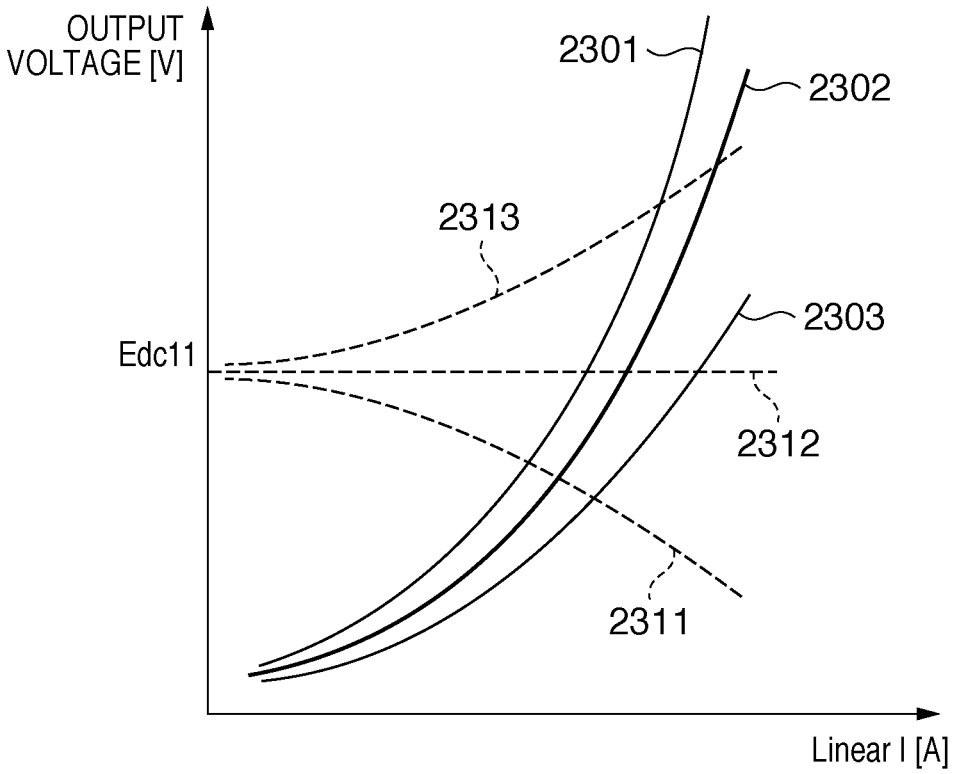
FIG. 23 shows the relationship between output voltage, the method of voltage feedback, and variation of the constant-voltage element.

FIG. 23 shows the relationship between output voltage, the method of voltage feedback, and variation of the constant-voltage element. Here, the characteristics (so-called I-V characteristics) of output voltage relative to drive current when a varistor is used as the constant-voltage element will be described.

A solid line 2301 indicates, of the I-V characteristics of the varistor, I-V characteristics where variation is at an upper limit. A solid line 2302 indicates, of the I-V characteristics of the varistor, I-V characteristics where variation is average. A solid line 2303 indicates, of the I-V characteristics of the varistor, I-V characteristics where variation is at a lower limit.

A broken line 2311 indicates characteristics when the variation in I-V characteristics is at the upper limit, and feedback from the rectifier circuit side of the constant-voltage element has been adopted. A broken line 2312 indicates characteristics when the variation in I-V characteristics is average, and voltage of the load side of the constant-voltage element has been fed back. Note that the characteristics when the variation in I-V characteristics is average, and the voltage of the rectifier circuit side of the constant-voltage element has been fed back, overlap with the broken line 2312. A broken line 2313 indicates characteristics when the variation in I-V characteristics is at the lower limit, and voltage of the rectifier circuit side of the constant-voltage element has been fed back.

As is understood from FIG. 23, variation in the I-V characteristics of the varistor increases as the current increases. The varistor voltage changes depending on temperature. Here, it is assumed that constant-voltage control is performed with an output voltage Edc11 set as the target voltage. In this case, even if the voltage of the rectifier circuit side of the constant-voltage element is fed back using a control table that considers the variation center (solid line 2302) of the I-V characteristics of the varistor, the output voltage is greatly affected by the variation in characteristics of the varistor. In particular, the variation in output voltage increases as the current increases.

On the other hand, when the voltage of the load side of the constant-voltage element is fed back, the output voltage is not easily affected by the variation in characteristics of the varistor, and so it is possible to stably control the output voltage Edc11 (broken line 2312). Also, when a Zener diode is used as the constant-voltage element, voltage is more stable than when a varistor is used. However, even in the case of a Zener diode, the Zener voltage is variable depending on the load current and temperature.

In this way, the output voltage is less affected by variation of the constant-voltage element or variation of the external load when the voltage of the load side is fed back than when feeding back the voltage of the rectifier circuit side of the constant-voltage element. Thus, it is possible to perform stable constant-voltage control. In particular, in a high-voltage power supply that supplies voltage to a contact charging system that includes a charging roller, variation of the voltage applied to the charging roller affects image darkness. For example, a problem also occurs that image darkness varies for each page that has been printed. Therefore, it is important to stabilize the voltage that is supplied by the high-voltage power supply apparatus.

As described above, in a high-voltage power supply apparatus having spurious characteristics, a constant-voltage element (example: the varistor 120) is inserted into a path that couples a piezoelectric transformer and an output terminal. Thus, a high-voltage power supply apparatus is provided in which the voltage at a spurious frequency is decreased while maintaining as much as possible the voltage at the resonance frequency of the piezoelectric transformer, so that a wide voltage range can be controlled with a comparatively low cost design.

By adopting, for example, a constant-voltage element that has non-linear I-V characteristics such as a varistor or a Zener diode, it is possible to suppress spuriousness of the piezoelectric transformer with a comparatively low cost and simple design. If spuriousness can be suppressed, it is possible to output voltage throughout a comparatively wide range. In particular, during low voltage output, voltage can be controlled with little effect from spurious frequencies. Thus, stable voltage control in a low voltage region is possible.

In a case where, for example, low voltage output control is necessary because the resistance value of the external load is small, it is possible to stably output low voltage with little effect from spurious frequencies. On the other hand, if the high-voltage power supply apparatus of this exemplary embodiment is adopted in an image forming apparatus, it is possible to improve the effect of improving the ghosting described above. At the same time, it is possible to shorten the time needed to exceed the spurious frequencies when starting up for high voltage. Thus, the time needed for high voltage startup is shortened.

Here, the reason that the time needed for high voltage startup can be shortened will be described based on an operation to start up to a desired output voltage Edc. Here, the polarity of the output voltage is positive, and frequency control is performed in a higher frequency range than the resonance frequency f0. Also, the circuit design here is a constant-voltage control circuit (FIG. 1) employing negative feedback control. Furthermore, the voltage-controlled oscillator 110 operates such that the output frequency is increased when the input voltage rises, and the output frequency is decreased when the input voltage decreases.

A voltage Vcont that corresponds to a desired output voltage Edc is input to an inverting input terminal (– terminal) of an op-amp 109. On the other hand, a voltage Vsns that has been generated by dividing a voltage Vout of an output terminal 117 with resistors 105, 106, 107, and the like is input to a non-inverting input terminal (+ terminal) of the op-amp 109.

When the output terminal voltage Vout is lower than the desired output voltage Edc, Vsns is less than Vcont, so the output voltage of the op-amp 109 decreases. Because the input voltage of the voltage-controlled oscillator 110 decreases, a control that reduces the output frequency is performed. That is, because the drive frequency of the piezoelectric transformer 101 decreases, the drive frequency is swept in a direction that moves closer to the resonance frequency f0, and the output terminal voltage Vout also moves closer to the desired output voltage Edc.

Also, the frequency sweep time is determined by a time constant of an integrator circuit that has been configured from the op-amp 109, a resistor 114, and a capacitor 113, and by an input difference voltage of the op-amp 109. However, the resistor 114 and the capacitor 113 have fixed constants in the circuit design, so the input difference voltage of the op-amp 109 is dominant. A sweep time t is defined by $$t=(CXR)\div(V\text{cont}-Vsns).$$

That is, the sweep time t decreases as the difference voltage of the non-inverting input terminal Vsns and the inverting input terminal Vcont increases. The time for change of the output voltage of the op-amp 109 is shortened, and thus the time for change of the output frequency from the voltage-controlled oscillator 110 also is shortened. However, this can be achieved provided that in the frequency-voltage characteristics that express the relationship between frequency and voltage in the course of sweeping the frequency, there is no large distortion or undulation in the output voltage.

When a spurious frequency is present in the course of sweeping the frequency, the difference voltage of Vsns and Vcont is temporarily reduced, and the frequency sweep time is lengthened. This sweep time grows longer as the number of spurious frequencies increase, and as distortion of the output voltage in spurious frequencies increases. If the sweep time is lengthened, the time taken to reach the desired output voltage is also lengthened.

From this as well, it is understood that the time can be shortened by reducing distortion of the output voltage in spurious frequencies.

That is, if, as in this exemplary embodiment, it is possible to reduce distortion of the output voltage in spurious frequencies using a constant-voltage element such as a varistor, the frequency can be swept in a short time. That is, the voltage startup time can be shortened.

In a case where high voltage output control is necessary because the external load resistance value is high, in the high-voltage power supply apparatus according to this exemplary embodiment, the output voltage at the resonance frequency f0 decreases to less than the output voltage of a conventional circuit that does not have the varistor 120. Thus, it is necessary to perform control while taking into consideration a voltage margin. However, in the high-voltage power supply apparatus according to this exemplary embodiment, the voltage difference from a conventional circuit is much smaller than for a high-voltage power supply apparatus in which a resistor is inserted into the current path instead of the varistor 120. Thus, if control is performed at or below the highest voltage, the above problems also are unlikely to be revealed.

Also, in this exemplary embodiment, for ease of understanding, two representative values 10 MΩ and 100 MΩ are used as the resistance values of the external load. However, these values are only examples. That is, the high-voltage power supply apparatus according to this exemplary embodiment generally exhibits effective characteristics even when the resistance value of the external load is another value. This is also true for exemplary embodiments described below.

Further, in this exemplary embodiment, a configuration was described in which output voltage is increased by changing the drive frequency of the piezoelectric transformer from the high frequency side to the low frequency side. However, it is also possible to increase output voltage by changing the drive frequency from the low frequency side to the high frequency side. The configuration according to this exemplary embodiment is effective also in this case. This is also true for exemplary embodiments described below.

Furthermore, with this exemplary embodiment, it is possible to suppress as much as possible a reduction in the highest voltage at the resonance frequency. Also, it is possible to relatively increase the spuriousness suppression effect by feeding back the voltage of the load side after passing through the constant-voltage element. Also, the output voltage is less affected by the external load of the constant-voltage element, variations in temperature, and the like, so stable output voltage control is realized. This also contributes greatly to stabilizing the image darkness of an image forming apparatus.

Embodiment 2

Below, Embodiment 2 of the invention will be described based on FIGS. 6, 7, and 8. However, a description of matters described in Embodiment 1 will be omitted here.

Figure 6:
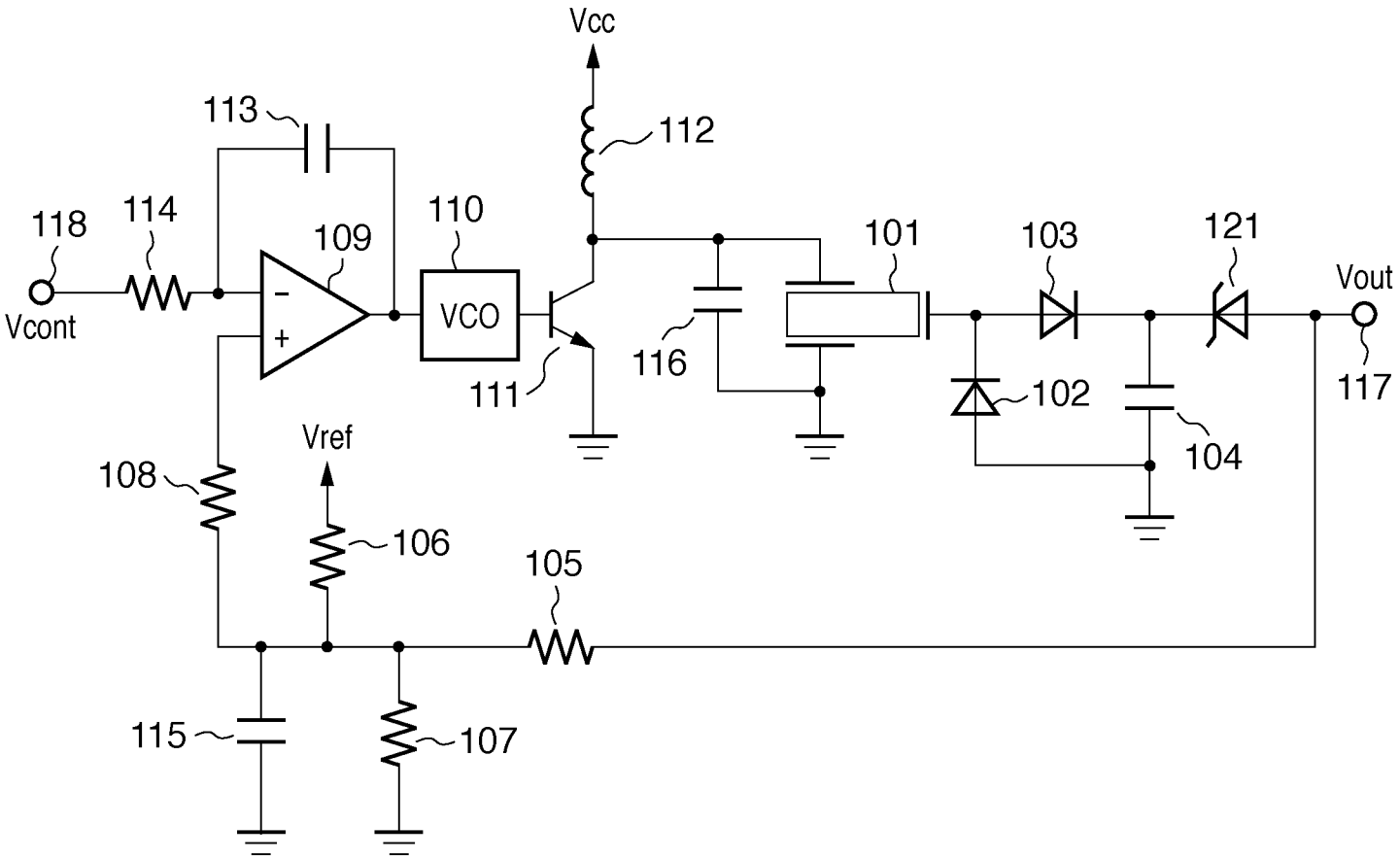
FIG. 6 is a circuit diagram of a piezoelectric transformer type high-voltage power supply apparatus according to Embodiment 2.

FIG. 6 is a circuit diagram of a piezoelectric transformer type high-voltage power supply apparatus according to Embodiment 2. Embodiment 2 mainly differs from Embodiment 1 in that a Zener diode 121 is adopted as a constant-voltage element.

Figure 7:
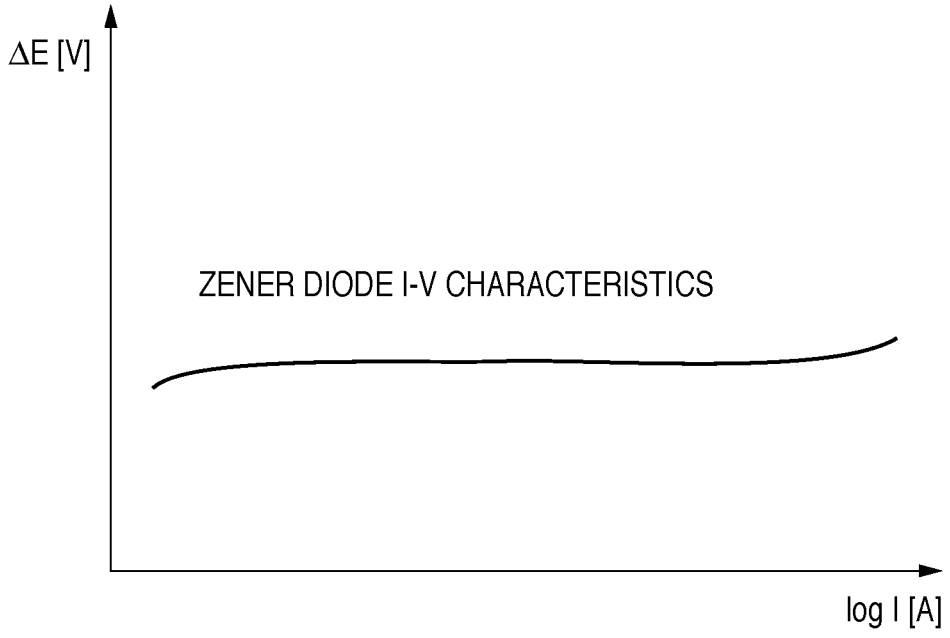
FIG. 7 shows current-voltage characteristics of an ordinary Zener diode 121.

FIG. 7 shows current-voltage characteristics of an ordinary Zener diode 121. The horizontal axis indicates current I (logarithmic). The vertical axis indicates the both-end voltage of the Zener diode 121. As is understood from a comparison of FIG. 7 and FIG. 2, the voltage characteristics of the Zener diode 121 do not depend on the current that flows to the extent of a varistor. Thus, with respect to the both-end voltage ΔE of the Zener diode 121, the Zener voltage is maintained in a wide current range.

Figure 8A:
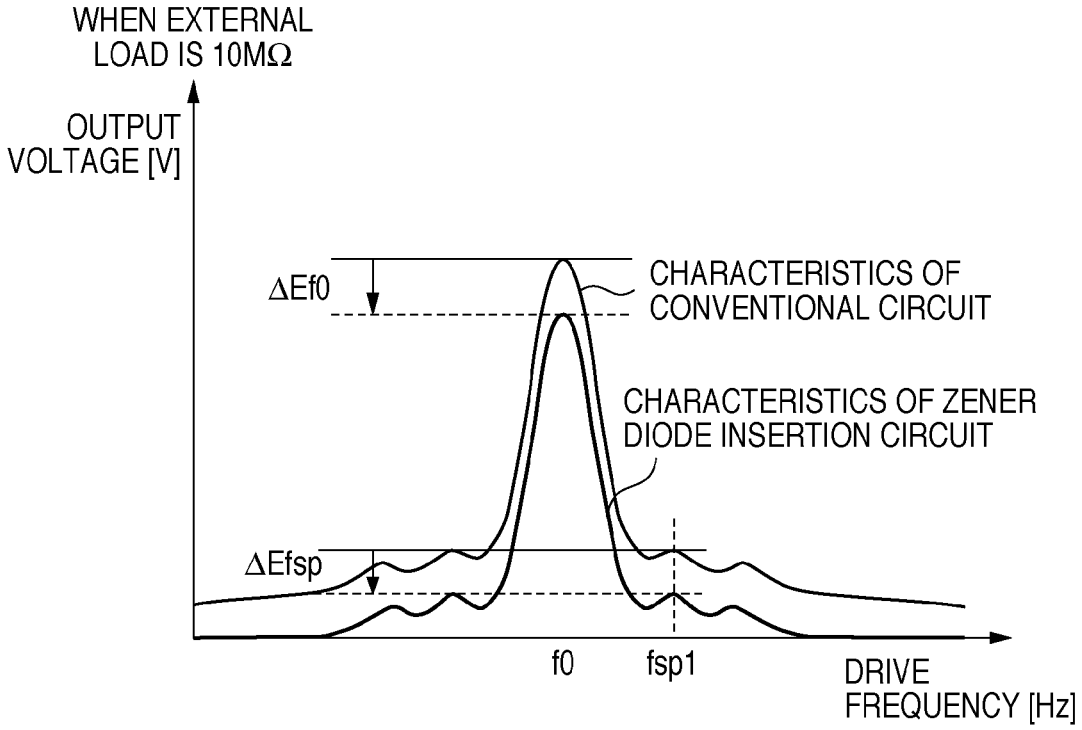
FIG. 8A shows frequency characteristics for a case where a Zener diode is inserted (Zener diode insertion circuit) and a case where a Zener diode is not inserted (conventional circuit), when an external load is set to 10 MΩ.
Figure 8B:
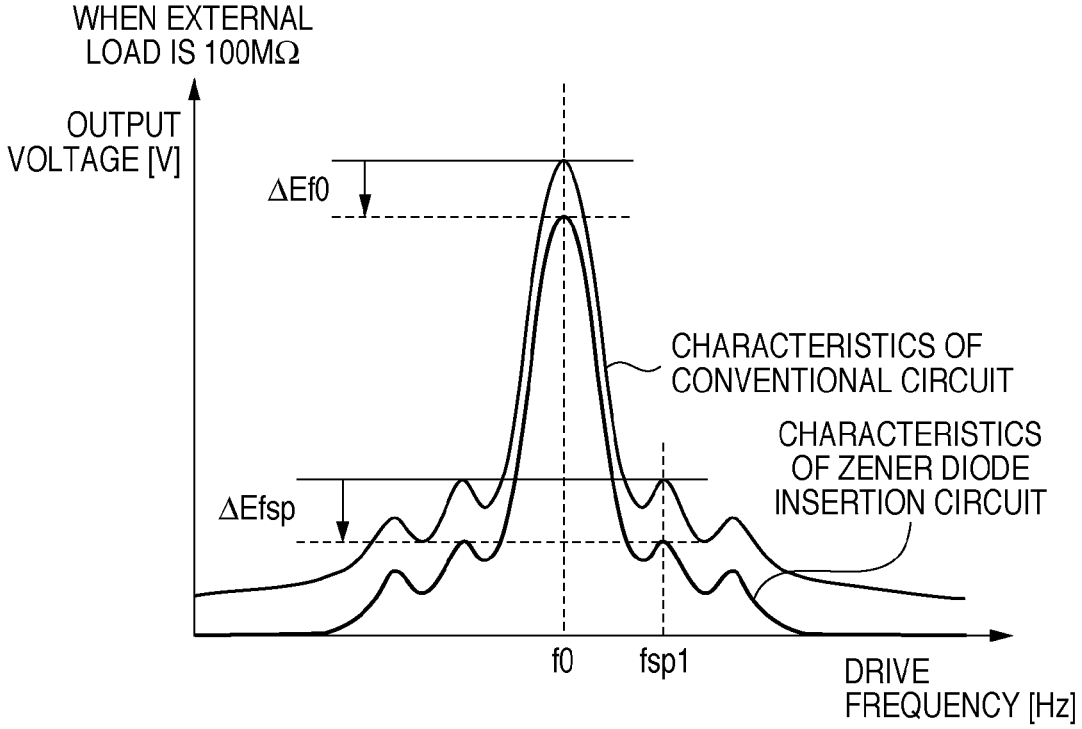
FIG. 8B shows frequency characteristics for a case where a Zener diode is inserted and a case where a Zener diode is not inserted, when an external load is set to 100 MΩ.

FIG. 8A shows frequency characteristics for a case where a Zener diode is inserted (Zener diode insertion circuit) and a case where a Zener diode is not inserted (conventional circuit), when an external load is set to 10 MΩ. FIG. 8B shows frequency characteristics for a case where a Zener diode is inserted and a case where a Zener diode is not inserted, when an external load is set to 100 MΩ. Note that in FIGS. 8A and 8B, the scales of the vertical axis and the horizontal axis are the same. The characteristics of a conventional circuit change according to the resistance value of the external load, as described in Embodiment 1.

As features of this exemplary embodiment, from a graph (FIG. 8A) when the external load is 10 MΩ, the following can be said. With respect to the difference in the characteristics of a conventional circuit and the characteristics of a Zener diode insertion circuit, ΔEf0 is the difference in voltage at the resonance frequency f0, and ΔEfsp is the difference in voltage at the spurious frequency fsp1. In this case, $$\Delta Ef0 \approx \Delta Efsp$$

and both ΔEf0 and ΔEfsp have about the same value.

When the external load is fixed across the entire drive frequency range, the current I is greater with high voltage output at the resonance frequency f0 than with low voltage output at the spurious frequency fsp1. However, according to the characteristics of the Zener diode 121 shown in FIG. 7, the potential difference ΔE is almost unaffected by the current I. The same can be said for a graph (8B) when the external load is 100 MΩ. Thus, the size of the load resistance does not depend on the potential difference ΔE.

The same effects are obtained with the circuit design of Embodiment 2 as with Embodiment 1. Further, regardless of the current value, which depends on the resistance value of the external load and the output voltage, with the high-voltage power supply apparatus of Embodiment 2 it is possible to generate a constant voltage difference. Thus, improvement of design precision is also obtained as an effect.

Embodiment 3

Figure 9:
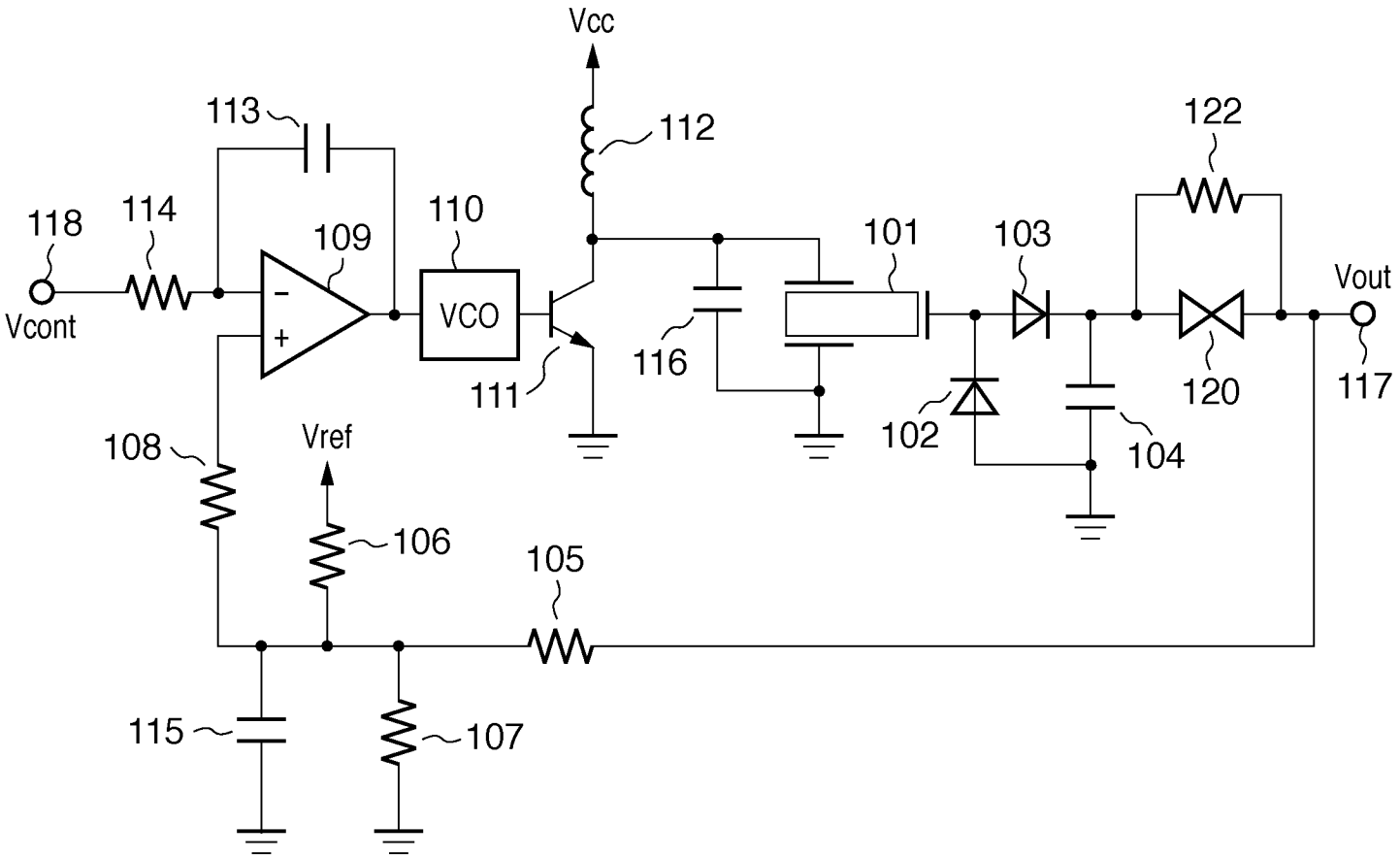
FIG. 9 is a circuit diagram of a piezoelectric transformer type high-voltage power supply apparatus according to Embodiment 3.

Below, Embodiment 3 of the invention will be described based on FIGS. 9, 10, and 11. However, a description of matters described in the previous exemplary embodiments will be omitted here. FIG. 9 is a circuit diagram of a piezoelectric transformer type high-voltage power supply apparatus according to Embodiment 3. Embodiment 3 mainly differs from the previous exemplary embodiments in that a varistor 120 is inserted as a constant-voltage element, and a resistor 122 is further connected in parallel relative to the varistor 120.

Figure 10:
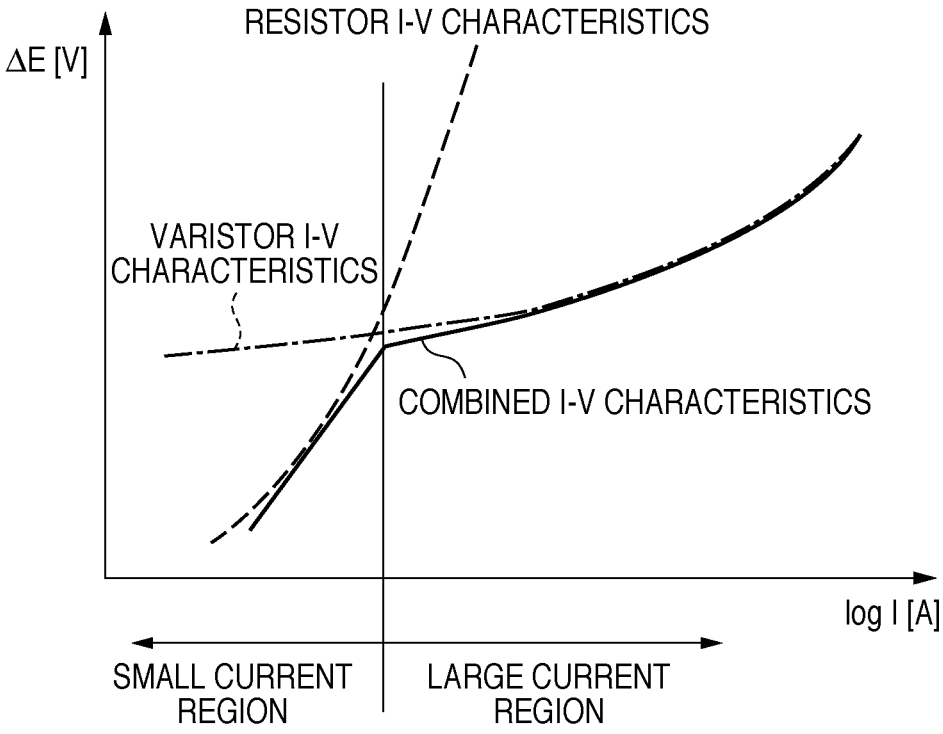
FIG. 10 shows current-voltage characteristics when the varistor 120 and a resistor 122 are connected in parallel.

FIG. 10 shows current-voltage characteristics when the varistor 120 and a resistor 122 are connected in parallel. The horizontal axis indicates the current I (logarithmic). The vertical axis indicates the both end voltage of the varistor. As features of this exemplary embodiment, I-V characteristics of the resistor in a region where current is small are dominant, and I-V characteristics of the varistor in a region where current is large are dominant. That is, in a region where current is small, a voltage divided by the resistance value and the external load is present at the output terminal 117, and in a region where current is large, a voltage according to the constant-voltage characteristics of the varistor shown in Embodiment 1 is present at the output terminal 117.

Figure 11A:
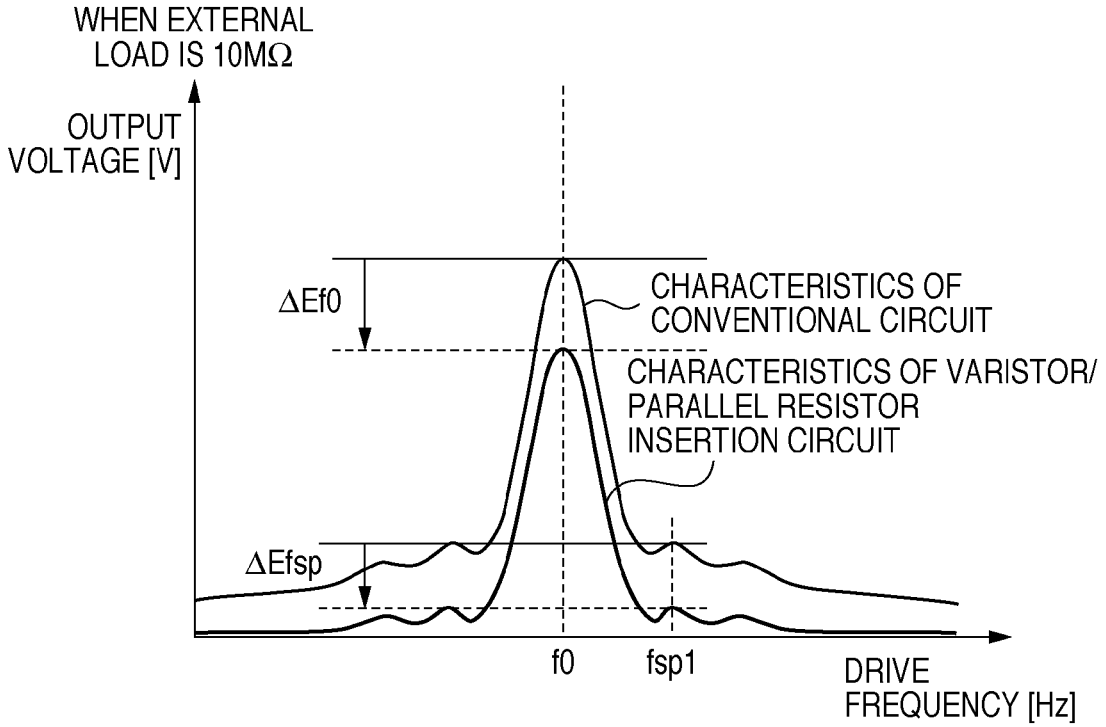
FIG. 11A shows frequency characteristics for a case where a varistor and a parallel resistor are inserted (varistor/parallel resistor insertion circuit) and a case where a varistor and a parallel resistor are not inserted (conventional circuit), when an external load is set to 10 MΩ.
Figure 11B:
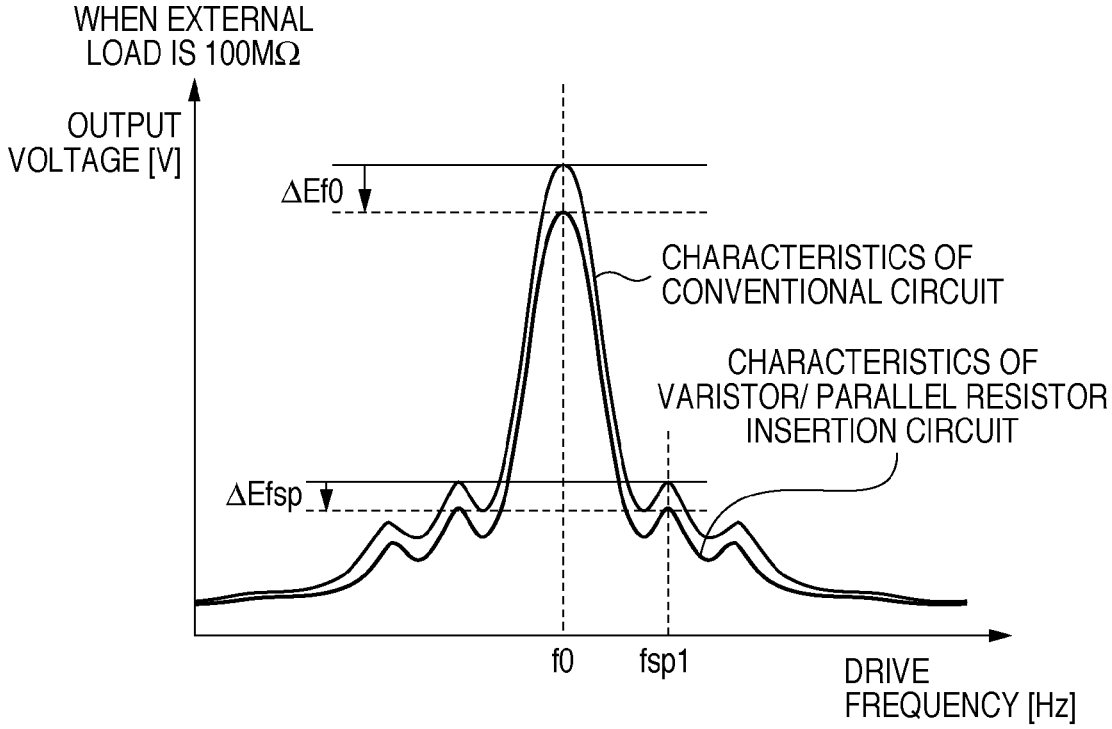
FIG. 11B shows frequency characteristics for a case where a varistor and a parallel resistor are inserted and a case where a varistor and a parallel resistor are not inserted, when an external load is set to 100 MΩ.

FIG. 11A shows frequency characteristics for a case where a varistor and a parallel resistor are inserted (varistor/parallel resistor insertion circuit) and a case where a varistor and a parallel resistor are not inserted (conventional circuit), when an external load is set to 10 MΩ. FIG. 11B shows frequency characteristics for a case where a varistor and a parallel resistor are inserted and a case where a varistor and a parallel resistor are not inserted, when an external load is set to 100 MΩ. Note that in FIGS. 11A and 11B, the scales of the vertical axis and the horizontal axis are the same. The characteristics of a conventional circuit change according to the resistance value of the external load, as described in Embodiment 1.

The following matters can be stated as features of this exemplary embodiment. With respect to the difference in the characteristics of a conventional circuit and the characteristics of a varistor/parallel resistor insertion circuit, ΔEf0 is the difference in voltage at the resonance frequency f0, and ΔEfsp is the difference in voltage at the spurious frequency fsp1.

In this case, $$\Delta Ef0 > \Delta Efsp$$

and $$\Delta Ef0(\text{external load } 10\ \text{M}\Omega) > \Delta Ef0(\text{external load } 100\ \text{M}\Omega)$$

$$\Delta Efsp(\text{external load } 10\ \text{M}\Omega) > \Delta Efsp(\text{external load } 100\ \text{M}\Omega).$$

When the external load is fixed across the entire drive frequency range, with low voltage output at the spurious frequency fsp1, the current I is small, so the I-V characteristics of the resistor are dominant. Also, with high voltage output at the resonance frequency f0, the current I is large, so the I-V characteristics of the varistor are dominant. Thus, ΔEf0 is a larger value than ΔEfsp. Further, because more current flows as the resistance value of the external load decreases, the value of ΔEf0 when the external load is 10 MΩ is larger than the value of ΔEf0 when the external load is 100 MΩ.

The high-voltage power supply apparatus of this exemplary embodiment exhibits the same effects as Embodiments 1 and 2. Further, it is possible to reduce as much as possible the voltage difference when it is necessary to set a high voltage, and to generate an adequate voltage difference when it is necessary to set a low voltage, thus reducing the output voltage at the spurious frequency fsp1. Also, it is thus possible to increase the output voltage range, so it is possible to provide a very versatile high-voltage power supply apparatus.

Embodiment 4

Below, Embodiment 4 of the invention will be described based on FIGS. 12, 13, and 14. However, a description of matters described in the previous exemplary embodiments will be omitted here.

Figure 12:
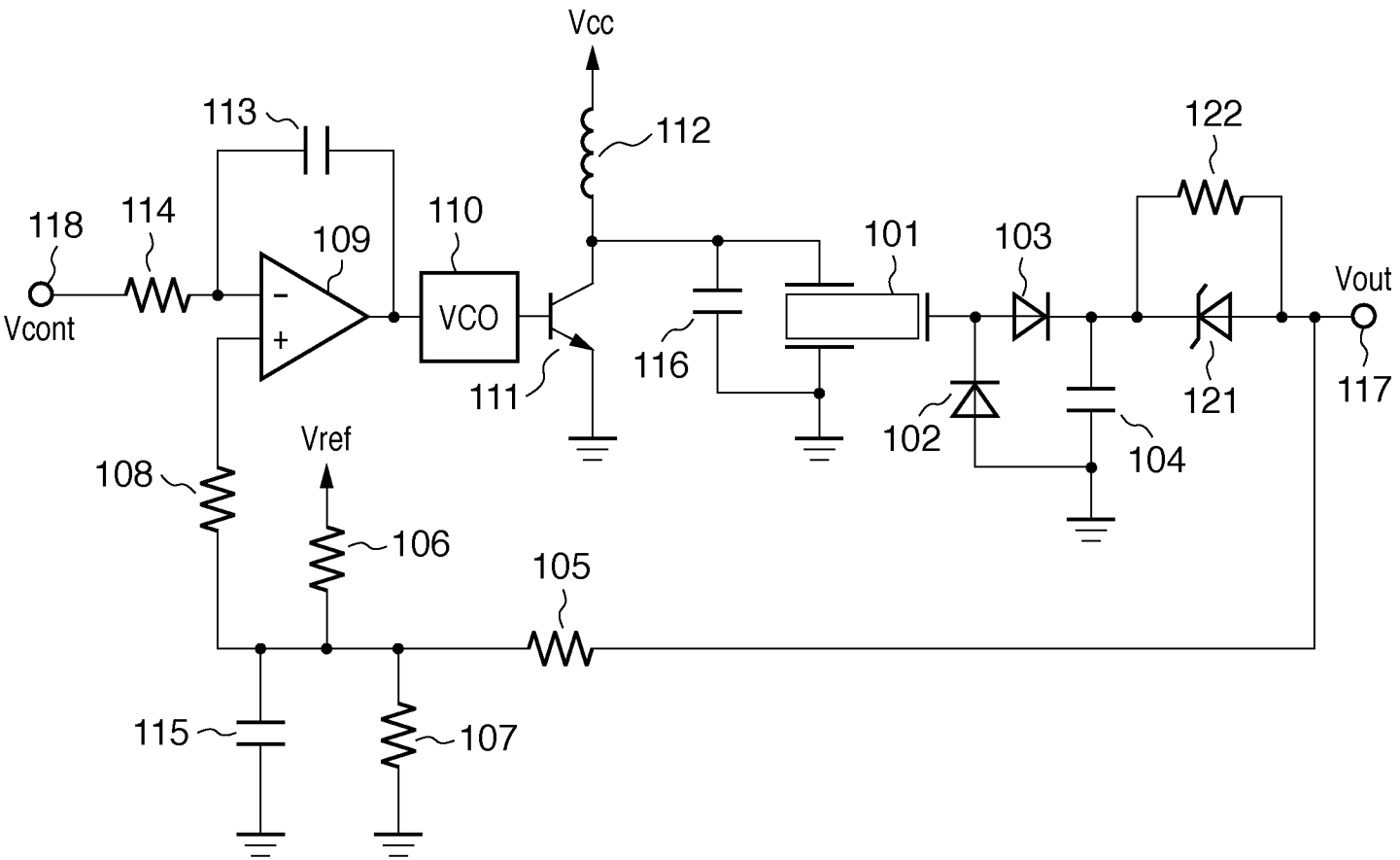
FIG. 12 is a circuit diagram of a piezoelectric transformer type high-voltage power supply apparatus according to Embodiment 4.

FIG. 12 is a circuit diagram of a piezoelectric transformer type high-voltage power supply apparatus according to Embodiment 4. Embodiment 4 mainly differs from the previous exemplary embodiments in that a Zener diode 121 is inserted as a constant-voltage element, and a resistor 122 is further connected in parallel relative to the Zener diode 121.

Figure 13:
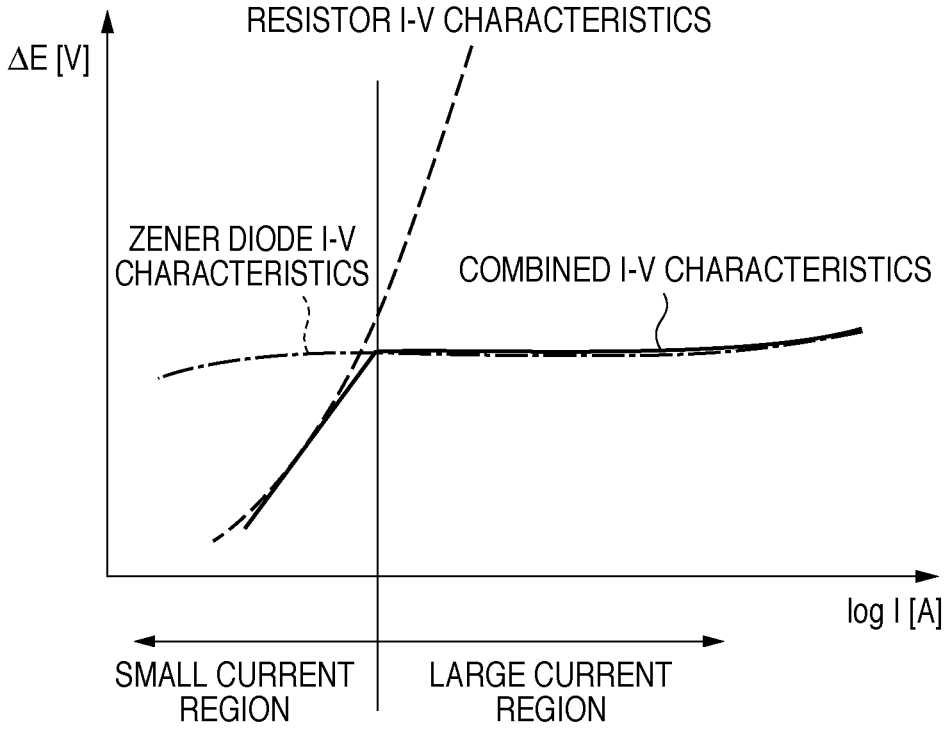
FIG. 13 shows current-voltage characteristics when the Zener diode 121 and the resistor 122 are connected in parallel.

FIG. 13 shows current-voltage characteristics when the Zener diode 121 and the resistor 122 are connected in parallel. The horizontal axis indicates the current I (logarithmic). The vertical axis indicates the both end voltage of the Zener diode 121. As features of this exemplary embodiment, I-V characteristics of the resistor in a region where current is small are dominant, and I-V characteristics of the Zener diode in a region where current is large are dominant.

That is, in a region where current is small, a voltage divided by the resistance value and the external load is present at the output terminal 117, and in a region where current is large, a voltage according to the constant-voltage characteristics (FIG. 7) of the Zener diode shown in Embodiment 2 is present at the output terminal 117.

Figure 14A:
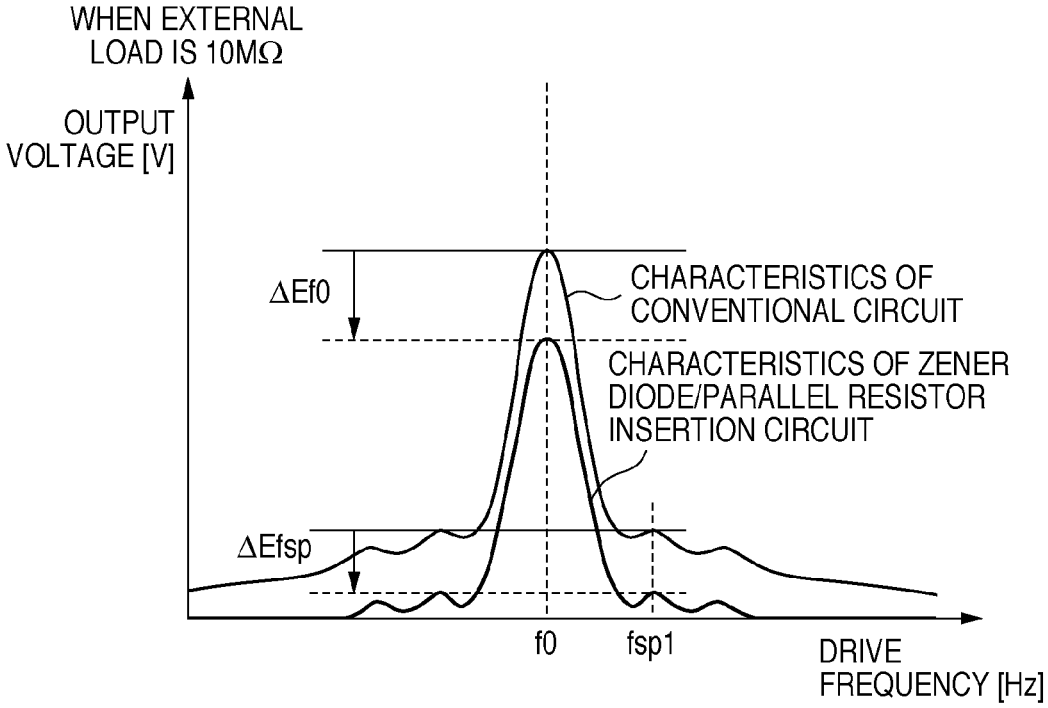
FIG. 14A shows frequency characteristics for a case where a Zener diode and a parallel resistor are inserted (Zener diode/parallel resistor insertion circuit) and a case where a Zener diode and a parallel resistor are not inserted (conventional circuit), when an external load is set to 10 MΩ.
Figure 14B:
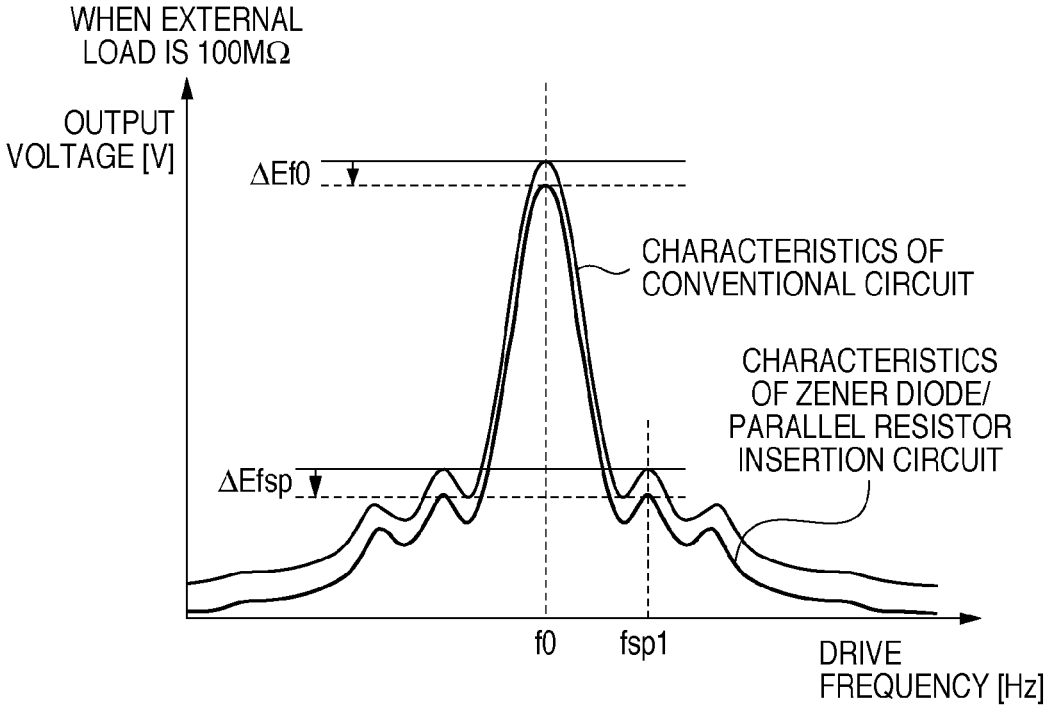
FIG. 14B shows frequency characteristics for a case where a Zener diode and a parallel resistor are inserted and a case where a Zener diode and a parallel resistor are not inserted, when an external load is set to 100 MΩ.

FIG. 14A shows frequency characteristics for a case where a Zener diode and a parallel resistor are inserted (Zener diode/parallel resistor insertion circuit) and a case where a Zener diode and a parallel resistor are not inserted (conventional circuit), when an external load is set to 10 MΩ. FIG. 14B shows frequency characteristics for a case where a Zener diode and a parallel resistor are inserted and a case where a Zener diode and a parallel resistor are not inserted, when an external load is set to 100 MΩ. Note that in FIGS. 14A and 14B, the scales of the vertical axis and the horizontal axis are the same. The characteristics of a conventional circuit change according to the resistance value of the external load, as described in Embodiment 1.

The following matters can be stated as features of this exemplary embodiment. With respect to the difference in the characteristics of a conventional circuit and the characteristics of a Zener diode/parallel resistor insertion circuit, ΔEf0 is the difference in voltage at the resonance frequency f0, and ΔEfsp is the difference in voltage at the spurious frequency fsp1.

In the case of external load 10 MΩ, $$\Delta Ef0 > \Delta Efsp.$$

On the other hand, in the case of external load 100 MΩ, $$\Delta Ef0 \approx \Delta Efsp.$$

Furthermore, $$\Delta Ef0(\text{external load } 10\ \text{M}\Omega) > \Delta Ef0(\text{external load } 100\ \text{M}\Omega)$$

$$\Delta Efsp(\text{external load } 10\ \text{M}\Omega) > \Delta Efsp(\text{external load } 100\ \text{M}\Omega).$$

Thus, when the external load is fixed at 100 MΩ across the entire drive frequency range, the I-V characteristics of the Zener diode have a large influence. Therefore, the current I is greater with high voltage output at the resonance frequency f0 than with low voltage output at the spurious frequency fsp1. However, due to the characteristics (FIG. 7) of the aforementioned Zener diode 121, almost no difference appears between the potential difference ΔEf0 and ΔEfsp.

On the other hand, when the external load is fixed at 10 MΩ, the I-V characteristics of the resistor have a great influence. Therefore, the current I is greater with high voltage output at the resonance frequency f0 than with low voltage output at the spurious frequency fsp1. Also, ΔEf0 is a larger value than ΔEfsp. Further, because more current flows as the resistance value of the external load decreases, the value of ΔEf0 when the external load is 10 MΩ is larger than the value of ΔEf0 when the external load is 100 MΩ.

The high-voltage power supply apparatus of this exemplary embodiment exhibits the same effects as the previous exemplary embodiments. Further, by using a Zener diode with low current dependency, it is possible to reduce as much as possible the voltage difference when it is necessary to set a high voltage. Also, because the resistor is connected in parallel, when it is necessary to set a low voltage, it is possible to generate an adequate voltage difference to decrease the output voltage at the spurious frequency fsp1. According to this exemplary embodiment, it is possible to increase the output voltage range, and so it is possible to provide a very versatile circuit.

Embodiment 5

Following is a description of an example of an image forming apparatus in which the high-voltage power supply apparatus described above can be adopted. The image forming apparatus can be realized as, for example, a printing apparatus, a printer, a copy machine, a multifunction peripheral, or a facsimile machine.

FIG. 15 is a configuration diagram of a color laser printer according to Embodiment 5. A color laser printer 401 is an example of an image forming apparatus, and forms images using an electrophotographic process. A deck 402 is a storage unit that stores a recording material 32. A pickup roller 404 is a paper supply unit that feeds out the recording material 32 from the deck 402. The recording material, for example, may also be referred to as a recording medium, paper, sheet, transfer material, or transfer paper. A deck supply roller 405 transports the recording material 32 that has been fed out by the pickup roller 404 further downstream. A retardation roller 406 forms a pair with the deck supply roller 405 and prevents double feeding of the recording material 32. A registration roller pair 407 that performs synchronized transport of the recording material 32 is provided downstream of the deck supply roller 405.

Also, an ETB (electrostatically attracting transport/transfer belt) 409 is disposed downstream of the registration roller pair 407. Four image forming units are provided along the ETB 409. These respectively correspond to four colors (yellow Y, magenta M, cyan C, and black Bk).

Each image forming unit is provided with a process cartridge 410, and a scanner unit 420. The scanner unit 420 outputs laser light that has been modulated based on respective image signals sent out from a video controller 440, described later, and forms an electrostatic latent image on an image carrier that has been uniformly charged. The scanner unit 420 also is an example of a latent image forming unit.

The process cartridge 410 is provided with a photosensitive drum 305, which is an example of an image carrier, a charging roller 303, a development roller 302, and a toner storage container 411, and is configured to be installable to/removable from the main body of the color laser printer 401. The photosensitive drum 305 is uniformly charged by the charging roller 303, and an electrostatic latent image is formed on the photosensitive drum 305 by scanning light from the scanner unit 420. The electrostatic latent image is developed by the development roller 302 using toner stored in the toner storage tank 411, thus forming a toner image. The development roller 302 is an example of a development unit. Afterward, the toner image is transferred to recording material by a transfer roller 430 to which a high voltage transfer bias voltage has been applied. The transfer roller 430 is an example of a transfer unit that transfers a toner image to recording material.

In the image forming units, respective toner images of differing colors are transferred in a multiplexed manner to recording material. Afterward, a fixing apparatus 450, which is an example of a fixing unit, fixes the toner image to the recording material to which the toner image has been transferred.

The video controller 440 receives image data that is sent out from an external apparatus 441 such as a personal computer, converts this image data into bitmap data, and generates an image signal for image forming.

A DC controller 460 is a control unit of the color laser printer 401. The DC controller 460 is configured with an MPU (microcomputer) 470, a nonvolatile memory apparatus (EEPROM), various input/output control circuits (not shown), and the like. Also, a high-voltage power supply apparatus 480 is the piezoelectric transformer type high-voltage power supply apparatus described above. The high-voltage power supply apparatus 480 supplies a high voltage charging bias voltage, a high voltage development bias voltage, and a high voltage transfer bias voltage, according to control signals from the DC controller 460. That is, the high-voltage power supply apparatus 480 functions as a unit that applies, to the transfer roller 430, a transfer voltage for expediting transfer of toner images to recording material.

In the color laser printer 401 of this exemplary embodiment, the high-voltage power supply apparatus described above is adopted, so while realizing reductions in size and cost, it is also possible to maintain image quality. That is, in comparison to a high-voltage power supply apparatus in which an electromagnetic transformer is adopted, the size of a high-voltage power supply apparatus in which a piezoelectric transformer is adopted can be made relatively small. Thus, it is also possible to achieve a reduction in the size of an image forming apparatus equipped with that high-voltage power supply apparatus. Also, in comparison to related art in which a series resistor is inserted and the series resistor is switched with a relay, with this exemplary embodiment, a constant-voltage element is adopted, so reduced cost of the image forming apparatus itself can also be realized. Furthermore, with a constant-voltage element, it is possible to decrease the voltage at spurious frequencies while maintaining as much as possible the voltage at a resonance frequency of the piezoelectric transformer, so a decrease in image quality can also be suppressed.

In this exemplary embodiment, the color laser printer 401 was described as an example of an image forming apparatus. However, the image forming apparatus of this invention is not limited to a color laser printer, and may also be a monochrome image forming apparatus.

In the exemplary embodiments described above, mainly, the high-voltage power supply apparatus was described as an apparatus that supplies a transfer bias voltage used in an image forming apparatus. However, this is only one example. For example, the high-voltage power supply apparatus according to this invention can also be adopted as a high-voltage power supply apparatus that supplies a charging bias voltage or a development bias voltage.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-148626, filed Jun. 4, 2007, Japanese Patent Application No. 2007-329209, filed Dec. 20, 2007 and Japanese Patent Application No. 2008-104947, filed Apr. 14, 2008 which are hereby incorporated by reference herein in their entirety.

What is claimed is:

1. A high-voltage power supply apparatus, comprising:

a piezoelectric transformer that outputs a voltage according to a frequency signal;

a generating unit that generates the frequency signal so as to drive a primary side of said piezoelectric transformer;

a voltage dropping unit that drops a voltage outputted from a secondary side of said piezoelectric transformer and outputs a dropped voltage, said voltage dropping unit being connected to said secondary side of said piezoelectric transformer; and a voltage detection unit that detects the dropped voltage outputted from said voltage dropping unit, wherein said generating unit controls the frequency signal based on a detection result of said voltage detection unit.

2. The high-voltage power supply apparatus according to claim 1, wherein said voltage dropping unit includes an element that suppresses a voltage at a spurious frequency generated in said piezoelectric transformer.

3. The high-voltage power supply apparatus according to claim 1, wherein said voltage dropping unit includes a varistor.

4. The high-voltage power supply apparatus according to claim 1, wherein said voltage dropping unit includes a Zener diode.

5. The high-voltage power supply apparatus according to claim 1, wherein said voltage dropping unit includes a varistor and a resistor, and wherein said resistor is connected in parallel with said varistor.

6. The high-voltage power supply apparatus according to claim 1, wherein said voltage dropping unit includes a Zener diode and a resistor, and wherein said resistor is connected in parallel with said Zener diode.

7. A high-voltage power supply apparatus, comprising:

an oscillator that controls a frequency of an output signal according to a control signal;

a switching unit that is driven by the output signal of said oscillator;

a piezoelectric transformer that is driven by said switching unit and outputs a voltage, said switching unit is connected to a primary side of said piezoelectric transformer;

a voltage dropping unit that drops a voltage outputted from a secondary side of said piezoelectric transformer and outputs a dropped voltage, said voltage dropping unit being connected to said secondary side of said piezoelectric transformer; and a voltage detection unit that detects the dropped voltage outputted from said voltage dropping unit, wherein said oscillator controls the frequency of the output signal based on a detection result of said voltage detection unit.

8. An image forming apparatus, comprising:

an image forming unit that forms an image; and a high-voltage power supply that supplies a dropped voltage to said image forming unit, wherein said high-voltage power supply includes:

a piezoelectric transformer that outputs a voltage according to a frequency signal;

a generating unit that generates the frequency signal so as to drive a primary side of said piezoelectric transformer;

a voltage dropping unit that drops a voltage outputted from a secondary side of said piezoelectric transformer and outputs the dropped voltage, said voltage dropping unit being connected to said secondary side of said piezoelectric transformer; and a voltage detection unit that detects the dropped voltage outputted from said voltage dropping unit, wherein said generating unit controls the frequency signal based on a detection result of said voltage detection unit.

9. The image forming apparatus according to claim 7, wherein said voltage dropping unit includes an element that suppresses a voltage at a spurious frequency generated in said piezoelectric transformer.

10. The image forming apparatus according to claim 7, wherein said voltage dropping unit includes a varistor.

11. The image forming apparatus according to claim 7, wherein said voltage dropping unit includes a Zener diode.

12. The image forming apparatus according to claim 7, wherein said voltage dropping unit includes a varistor and a resistor, and wherein said resistor is connected in parallel with said varistor.

13. The image forming apparatus according to claim 7, wherein said voltage dropping unit includes a Zener diode and a resistor, and wherein said resistor is connected in parallel with said Zener diode.

14. A high-voltage power supply apparatus, comprising:

a piezoelectric transformer that outputs a voltage according to a frequency signal;

a generating unit that generates the frequency signal so as to drive a primary side of said piezoelectric transformer;

a voltage dropping unit that drops a voltage outputted from a secondary side of said piezoelectric transformer such that a voltage corresponding to a spurious frequency, which is different from a resonance frequency corresponding to a maximum voltage outputted from said piezoelectric transformer, is reduced, and outputs a dropped voltage, said voltage dropping unit being connected to said secondary side of said piezoelectric transformer; and a voltage detection unit that detects the dropped voltage outputted from said voltage dropping unit, wherein said generating unit controls the frequency signal based on a detection result of said voltage detection unit.

15. An image forming apparatus, comprising:

an image forming unit that forms an image; and a high-voltage power supply that supplies a dropped voltage to said image forming unit, wherein said high-voltage power supply includes:

an oscillator that controls a frequency of an output signal according to a control signal;

a switching unit that is driven by the output signal of said oscillator;

a piezoelectric transformer that is driven by said switching unit and outputs a voltage, said switching unit being connected to a primary side of said piezoelectric transformer;

a voltage dropping unit that drops a voltage outputted from a secondary side of said piezoelectric transformer and outputs a dropped voltage, said voltage dropping unit being connected to said secondary side of said piezoelectric transformer; and a voltage detection unit that detects the dropped voltage outputted from said voltage dropping unit, wherein said oscillator controls the frequency of the output signal based on a detection result of said voltage detection unit.

* * * * *